US007989690B1

(12) United States Patent
Lawing

(10) Patent No.: US 7,989,690 B1
(45) Date of Patent: Aug. 2, 2011

(54) MUSICAL INSTRUMENT PICKUP SYSTEMS

(76) Inventor: Andrew Scott Lawing, Newark, DE (US)

( * ) Notice: Subject to any disclaimer, the term of this patent is extended or adjusted under 35 U.S.C. 154(b) by 82 days.

(21) Appl. No.: 12/568,659

(22) Filed: Sep. 28, 2009

Related U.S. Application Data

(63) Continuation-in-part of application No. 12/104,121, filed on Apr. 16, 2008, now Pat. No. 7,612,282.

(60) Provisional application No. 61/209,071, filed on Mar. 3, 2009, provisional application No. 61/194,597, filed on Sep. 29, 2008, provisional application No. 60/995,610, filed on Sep. 26, 2007, provisional application No. 60/923,607, filed on Apr. 16, 2007.

(51) Int. Cl.
*G10H 3/14* (2006.01)

(52) U.S. Cl. ..... 84/726; 84/723

(58) Field of Classification Search ..... 84/723, 84/725–728

See application file for complete search history.

(56) References Cited

U.S. PATENT DOCUMENTS

| | | | | | |
|---|---|---|---|---|---|
| 1,915,858 | A | * | 6/1933 | Miessner | 84/723 |
| 1,933,296 | A | * | 10/1933 | Jacobs | 84/735 |
| 1,977,939 | A | * | 10/1934 | Fichandler | 363/110 |
| 2,089,171 | A | * | 8/1937 | Beauchamp | 84/726 |
| 2,130,174 | A | * | 9/1938 | Beauchamp | 84/727 |
| 2,152,783 | A | * | 4/1939 | Beauchamp | 84/313 |
| 2,225,299 | A | * | 12/1940 | Demuth | 84/726 |
| 2,228,881 | A | * | 1/1941 | Le Clair | 84/733 |
| 2,310,199 | A | * | 2/1943 | Beauchamp | 84/723 |
| 2,455,575 | A | | 12/1948 | Fender et al. | |
| 2,896,491 | A | | 7/1959 | Lover | |
| 2,933,967 | A | | 4/1960 | Riscol | |
| 2,976,755 | A | * | 3/1961 | Fender | 84/727 |
| 3,035,472 | A | * | 5/1962 | Freeman | 84/726 |
| 3,249,677 | A | * | 5/1966 | Burns et al. | 84/726 |
| 3,483,303 | A | * | 12/1969 | Warner | 84/728 |
| 3,571,483 | A | * | 3/1971 | Davidson | 84/726 |
| 3,585,424 | A | * | 6/1971 | Neel | 310/25 |
| 3,588,311 | A | * | 6/1971 | Zoller | 84/725 |
| 3,675,529 | A | * | 7/1972 | Van Der Woerd | 84/455 |
| 3,711,619 | A | * | 1/1973 | Jones et al. | 84/726 |
| 3,748,367 | A | * | 7/1973 | Lamme et al. | 84/679 |
| 4,096,780 | A | | 6/1978 | Dawson | |
| 4,137,811 | A | * | 2/1979 | Kakehashi | 84/726 |
| 4,145,944 | A | * | 3/1979 | Helpinstill, II | 84/726 |
| 4,181,058 | A | * | 1/1980 | Suenaga | 84/726 |
| 4,182,213 | A | * | 1/1980 | Iodice | 84/728 |
| 4,212,220 | A | * | 7/1980 | Helpinstill, II | 84/726 |
| 4,230,013 | A | * | 10/1980 | Wellings | 84/733 |
| 4,348,930 | A | * | 9/1982 | Chobanian et al. | 84/726 |

(Continued)

FOREIGN PATENT DOCUMENTS

WO WO8704288 A2 7/1987

OTHER PUBLICATIONS

Donald Brosnac, "Velvet Hammer", Guitar Electronics for Musicians, 1983, p. 45, Omnibus Press.

*Primary Examiner* — David S. Warren
(74) *Attorney, Agent, or Firm* — ThePatentSource

(57) ABSTRACT

Musical instrument pickups comprising a plurality of coil-wire wrappings, each coil-wire wrapping having a particular geometric cross-section. Related embodiments exhibiting noise cancellation features are also disclosed.

20 Claims, 15 Drawing Sheets

U.S. PATENT DOCUMENTS 4,364,295 A * 12/1982 Stich ..... 84/726
4,372,186 A * 2/1983 Aaroe ..... 84/725
4,372,187 A 2/1983 Berg
4,378,722 A * 4/1983 Isakson ..... 84/726
4,499,809 A * 2/1985 Clevinger ..... 84/726
4,534,258 A * 8/1985 Anderson ..... 84/728
4,535,668 A * 8/1985 Schaller ..... 84/727
4,580,481 A * 4/1986 Schaller et al. ..... 84/727
4,581,974 A * 4/1986 Fender ..... 84/725
4,624,172 A * 11/1986 McDougall ..... 84/726
4,654,546 A * 3/1987 Kirjavainen ..... 307/400
4,750,397 A * 6/1988 Ashworth-Jones ..... 84/731
4,837,836 A * 6/1989 Barcus ..... 381/118
4,852,443 A * 8/1989 Duncan et al. ..... 84/733
4,907,483 A * 3/1990 Rose et al. ..... 84/726
5,012,716 A * 5/1991 Pagelli ..... 84/727
5,070,759 A * 12/1991 Hoover et al. ..... 84/726
5,111,728 A * 5/1992 Blucher et al. ..... 84/726
5,123,324 A * 6/1992 Rose et al. ..... 84/726
5,148,733 A * 9/1992 Beller ..... 84/726
5,168,117 A * 12/1992 Anderson ..... 84/726
5,206,449 A * 4/1993 McClish ..... 84/723
5,221,805 A * 6/1993 Lace ..... 84/726
5,233,123 A * 8/1993 Rose et al. ..... 84/726
5,292,998 A * 3/1994 Knapp ..... 84/726
5,335,576 A * 8/1994 Hayashi ..... 84/727
5,336,845 A * 8/1994 Lace, Sr. ..... 84/726
5,376,754 A * 12/1994 Stich ..... 84/728
5,389,731 A * 2/1995 Lace ..... 84/726
5,391,832 A * 2/1995 Lace ..... 84/726
5,399,802 A * 3/1995 Blucher ..... 84/726
5,408,043 A * 4/1995 Lace ..... 84/726
5,430,246 A * 7/1995 Lace, Sr. et al. ..... 84/726
5,523,526 A * 6/1996 Shattil ..... 84/728
5,530,199 A * 6/1996 Blucher ..... 84/728
5,567,903 A * 10/1996 Coopersmith et al. ..... 84/723
5,610,357 A * 3/1997 Frank-Braun ..... 84/726
5,894,101 A * 4/1999 Damm ..... 84/728
5,949,014 A * 9/1999 Rashak et al. ..... 84/725
6,043,422 A * 3/2000 Chapman ..... 84/723
6,078,006 A * 6/2000 Raisanen et al. ..... 84/733
6,111,184 A * 8/2000 Cloud et al. ..... 84/723
6,162,984 A * 12/2000 Engard ..... 84/743
6,211,671 B1 * 4/2001 Shattil ..... 324/225
6,372,976 B2 * 4/2002 Damm ..... 84/723
6,392,137 B1 * 5/2002 Isvan ..... 84/726
6,476,309 B2 11/2002 Gaglio
6,605,771 B1 * 8/2003 Baggs ..... 84/731
6,846,981 B2 * 1/2005 Devers ..... 84/728
6,849,792 B2 * 2/2005 Yeakel ..... 84/298
6,852,402 B2 * 2/2005 Kirjavainen et al. ..... 428/305.5
6,992,243 B2 * 1/2006 Small ..... 84/267
7,022,909 B2 * 4/2006 Kinman ..... 84/726
7,087,828 B2 * 8/2006 Krieger ..... 84/454
7,105,731 B1 * 9/2006 Riedl ..... 84/200
7,166,794 B2 * 1/2007 Juszkiewicz et al. ..... 84/728
7,189,916 B2 * 3/2007 Kinman ..... 84/726
7,199,302 B2 * 4/2007 Raisanen ..... 84/723
7,227,076 B2 * 6/2007 Stich ..... 84/726
7,285,714 B2 * 10/2007 Juszkiewicz et al. ..... 84/726
7,375,276 B2 * 5/2008 Kanayama et al. ..... 84/723
7,612,282 B1 * 11/2009 Lawing ..... 84/726
2002/0020281 A1 * 2/2002 Devers ..... 84/728
2002/0069749 A1 * 6/2002 Hoover et al. ..... 84/738
2002/0083819 A1 * 7/2002 Kinman ..... 84/726
2003/0051596 A1 * 3/2003 Gustafsson ..... 84/723
2005/0028669 A1 * 2/2005 Kavanaugh ..... 84/726
2005/0076775 A1 * 4/2005 Small ..... 84/743
2005/0126377 A1 * 6/2005 Kanayama et al. ..... 84/726
2006/0112816 A1 * 6/2006 Kinman ..... 84/728
2006/0150806 A1 * 7/2006 Hara ..... 84/726
2006/0272469 A1 * 12/2006 Meisel ..... 84/21
2006/0283311 A1 * 12/2006 Hosler ..... 84/723
2007/0056435 A1 * 3/2007 Juszkiewicz et al. ..... 84/726
2010/0122623 A1 * 5/2010 Salo ..... 84/726

* cited by examiner

8/15

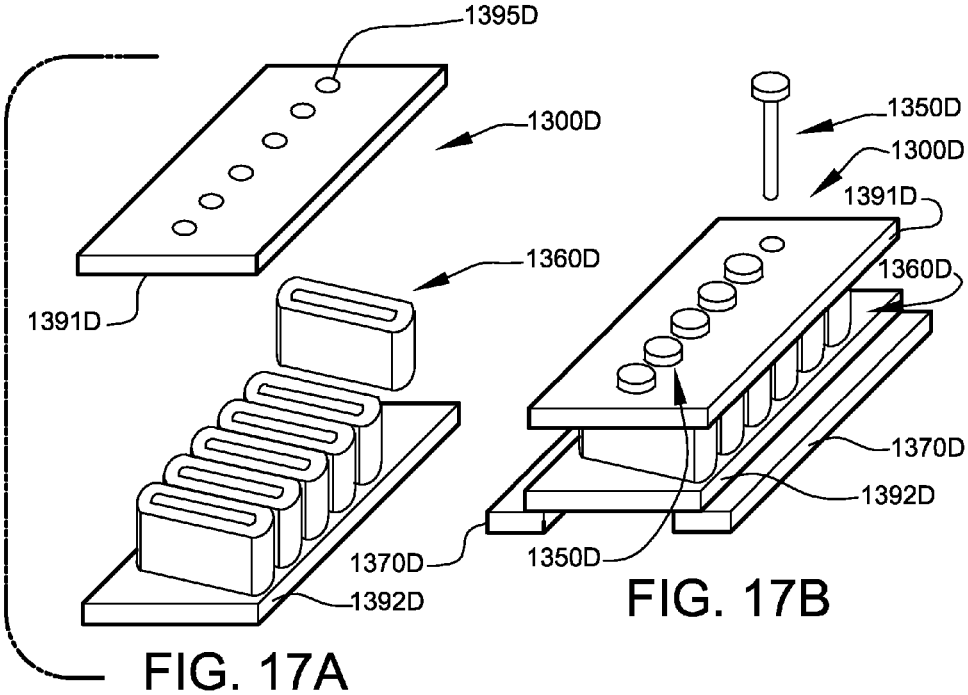
FIG. 17A
FIG. 17B
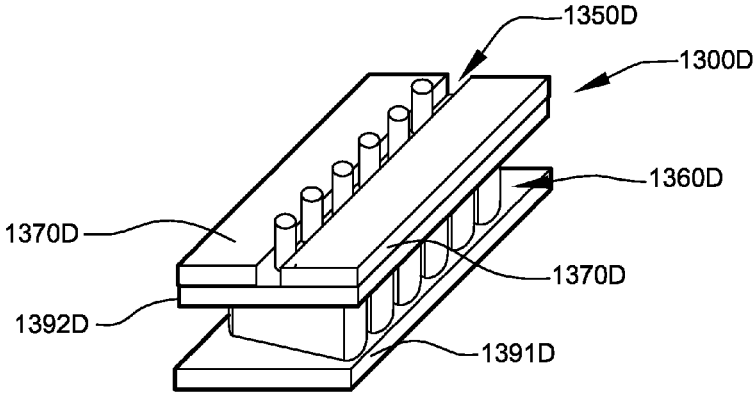
FIG. 17C

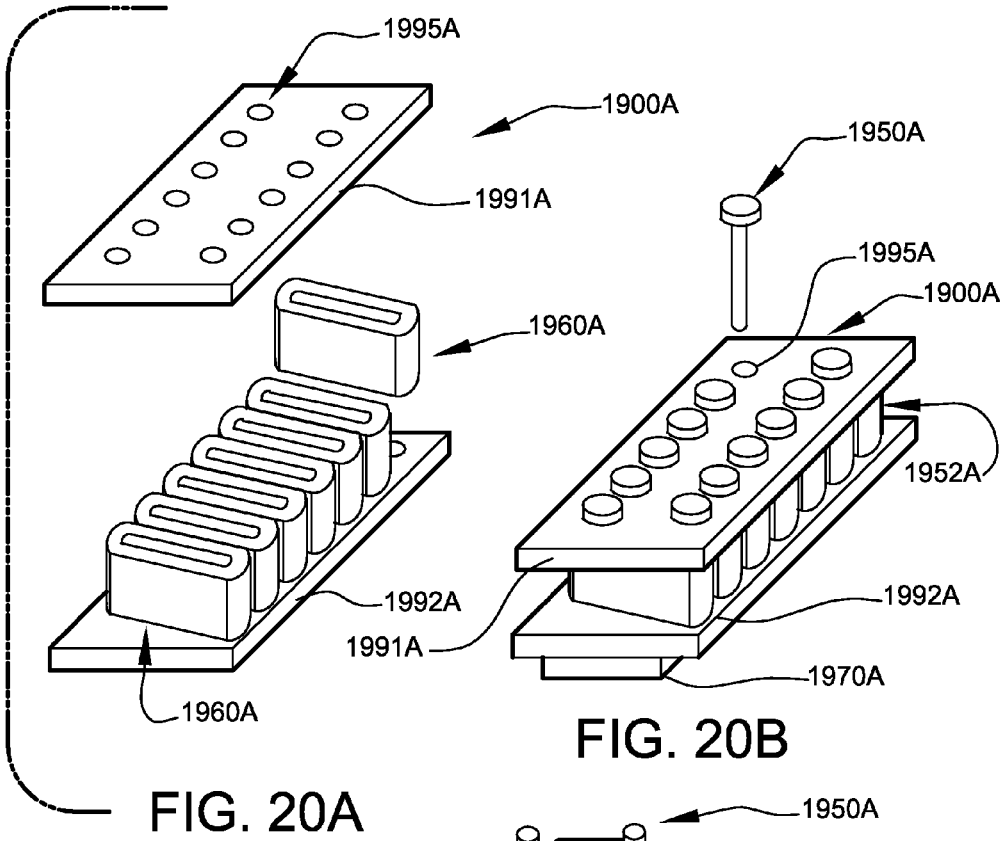
FIG. 20A
FIG. 20B
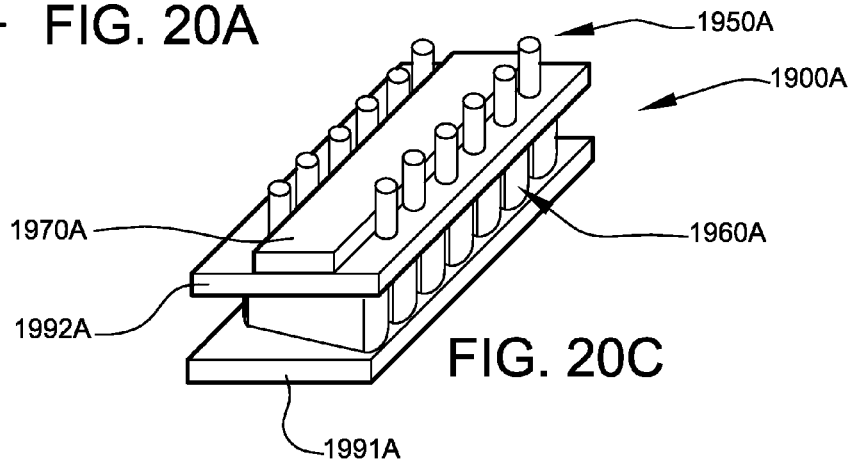
FIG. 20C

MUSICAL INSTRUMENT PICKUP SYSTEMS

CROSS REFERENCE TO RELATED APPLICATIONS

The present application is related to and claims priority from prior Provisional Patent Application Ser. No. 61/194,597, filed on Sep. 29, 2008, entitled "MUSICAL INSTRUMENT PICKUP" and prior Provisional Patent Application Ser. No. 61/209,071, filed on Mar. 3, 2009, entitled "MUSICAL INSTRUMENT PICKUP".

The present application is also a continuation-in-part application of patent application Ser. No. 12/104,121, filed Apr. 16, 2008, entitled "MUSICAL INSTRUMENT PICKUP", which is related to and claims priority from prior Provisional Patent Application Ser. No. 60/923,607, filed Apr. 16, 2007, entitled "MUSICAL INSTRUMENT PICKUP", and Prior Provisional Patent Application Ser. No. 60/995,610, filed Sep. 26, 2007, entitled "MUSICAL INSTRUMENT PICKUP", the contents all of which are incorporated herein by this reference and are not admitted to be prior art with respect to the present invention by the mention in this cross-reference section.

BACKGROUND

This invention relates to musical instrument pickups. More particularly this invention relates to providing a musical instrument pickup with improved sensitivity between magnetic pole pieces of the musical instrument pickup assembly. Also, this invention relates to providing a musical instrument pickup capable of fitting within a limited space wherein the musical instrument pickup achieves an output similar to that of a typical musical instrument pickup and a reduction in noisy interference while still maintaining desirable and recognizable tonal characteristics.

Certain musical instruments, especially electric guitars and other electric stringed instruments, typically use a magnetic transducer to convert mechanical string vibrations into electrical signals. The electrical signals are subsequently amplified with an amplification system and "played" through a loudspeaker. A musician typically selects musical-instrument electronic components to achieve a particular musician-desired tonal quality. For example, a guitar player may prefer analog circuitry to digital circuitry to achieve a more "vintage" tone. A guitar player's tone is directly related to the selection of desired amplifiers, guitars, and pickups (in addition to the playing style, finger pressure, etc., of the guitar player). With respect to guitar pickups, many factors, such as the number of coil winds, wire types, magnets, etc., affect a musician's tonal quality. Tonal quality is important as it imparts an expressive element from a musician to a listener.

Typical electric guitars use single-coil pickups. These typical single-coil pickups are susceptible to noisy interference known as "sixty cycle hum". Current solutions used to dissipate the noisy interference have a considerably different tonal quality than that of single-coil pickups. For example, "humbucking" pickups have a sound that is considered "fatter" and "thicker" than single-coil pickups that those knowledgeable in the art clearly are aware of and appreciate. Thus, there is a need for a musical instrument pickup that is less noisy than typical single-coil pickups, wherein the noise dissipation does not detract from the characteristic tonal quality of a single-coil pickup. Additionally, the embodiments, methods and concepts disclosed here extend the general applicability of the concepts disclosed in U.S. patent application Ser. No. 12/104,121 to some distinct and novel applications and provide for enhanced performance. In particular, the methods disclosed here will rectify the limitation of reduced field strength in the region between adjacent pole pieces with opposing magnetic fields by providing for a continuous string vibration sensing pattern in this region.

OBJECTS AND FEATURES OF THE INVENTION

A primary object and feature of the present invention is to provide a system overcoming the above-mentioned problems. It is a further object and feature of the present invention to provide a musical instrument pickup with improved pickup sensitivity between pole pieces. Still a further object and feature of the present invention is to provide a musical instrument pickup that is less noisy than typical single-coil pickups wherein the noise dissipation does not detract from the characteristic tonal quality of a single-coil pickup. A further object and feature of the present invention is to provide components that may be assembled together to construct a musical instrument pickup that overcomes the above-mentioned problems and meets the needs disclosed herein. A further object and feature of the present invention is to provide a method of constructing such a musical instrument pickup. A further object and feature of the present invention is to maximize the pickup output within a given available space.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a pickup system for at least one stringed musical instrument comprising a plurality of strings in a string plane, each string having a longitudinal axis, such pickup system comprising: a plurality of coil-wire wrappings; each coil-wire wrapping comprising coil wire surrounding an interior; such plurality of coil-wire wrappings adapted to be connected to the at least one stringed musical instrument in a coil-wire wrapping plane parallel to such string plane; each of such coil-wire wrappings comprising a coil-wire wrapping longitudinal axis in such coil-wire wrapping plane and each of such coil-wire wrappings being symmetrical about such longitudinal axis; wherein, when so connected, a string projection plane, containing one of the plurality of strings, perpendicular to both such string plane and such coil-wire wrapping plane, intersects such coil-wire wrapping longitudinal axis, forming angles in such coil-wire wrapping plane; wherein the measure of one of such angles is acute; wherein at least one plane, such plane being perpendicular to both such string plane and such coil-wire wrapping plane, and parallel to the longitudinal axis of the each string, intersects interiors of adjacent coil-wire wrappings. Moreover, it provides such a pickup system, wherein the measure of the acute angle is between about 10 and about 55 degrees. Additionally, it provides such a pickup system, wherein such interior is occupied by at least one pole piece. Also, it provides such a pickup system, wherein such at least one pole piece substantially fills such interior. In addition, it provides such a pickup system, wherein such interior is occupied by at least one pole piece and a matrix of magnetic or magnetically susceptible material. And, it provides such a pickup system, wherein such at least one pole piece comprises a rectangular plate. Further, it provides such a pickup system, wherein such at least one pole piece comprises at least one screw or slug.

Even further, it provides such a pickup system, wherein each coil-wire wrapping comprises a stadium-shaped cross-section. Moreover, it provides such a pickup system, wherein such pole pieces are magnetic and the magnetic pole orientations of such pole pieces and the effective winding directions of such coil wire wrappings are structured and arranged to achieve 60-cycle-hum canceling. Additionally, it provides such a pickup system, further comprising at least one magnetic plate wherein the magnetic pole orientation(s) of such at least one magnetic plate and the effective winding directions of such coil wire wrappings are structured and arranged to achieve 60-cycle-hum canceling. Also, it provides such a pickup system, wherein the geometric centers of such coil-wire wrappings are arranged in a single line. In addition, it provides such a pickup system, comprising six coil-wire wrappings. And, it provides such a pickup system, wherein an inter-string projection plane positioned about equidistant from adjacent strings, perpendicular to both such string plane and such coil-wire wrapping plane, and parallel to the longitudinal axis of the strings, intersects interiors of adjacent coil-wire wrappings. Further, it provides such a pickup system, wherein such string projection plane, containing one of the plurality of strings, perpendicular to both such string plane and such coil-wire wrapping plane, intersects interiors of adjacent coil-wire wrappings. Even further, it provides such a pickup system, wherein the number of coil-wire wrappings equals one greater than the number of strings of the at least one stringed musical instrument. Even further, it provides such a pickup system, wherein the measure of the acute angle is about 31 degrees. Even further, it provides such a pickup system, wherein such plurality of strings in a string plane comprises at least three strings being adjacent one another; such plurality of coil-wire wrappings comprise at least three coil-wire wrappings positioned adjacent one another; wherein such string projection plane through a "middle" string of such at least three adjacent strings is tangentially adjacent an external perimeter of a coil-wire wrapping to one side of such "middle" string plane and tangentially adjacent an external perimeter of another coil wire-wrapping to the other side of such "middle" string plane.

In accordance with another preferred embodiment hereof, this invention provides a pickup system for at least one stringed musical instrument comprising a plurality of strings in a string plane, at least three of which are adjacent one another, each such adjacent string having a longitudinal axis, such pickup system comprising: a plurality of coil-wire wrappings comprising; such plurality of coil-wire wrappings adapted to be connected to the at least one stringed musical instrument in a coil-wire wrapping plane parallel to such string plane; each of such at least coil-wire wrappings comprising a coil-wire wrapping longitudinal axis, in such coil-wire wrapping plane, and being symmetrical about such longitudinal axis; wherein, when so connected, a string projection plane, containing one of the plurality of strings, perpendicular to both such string plane and such coil-wire wrapping plane, intersects such coil-wire wrapping longitudinal axis, forming angles in such coil-wire wrapping plane; wherein the measure of one of such angles is acute.

In accordance with a preferred embodiment hereof, this invention provides a musical instrument pickup system, relating to a stringed instrument having at least one string, comprising: a plurality of independent coil-wire wrappings, each having a geometric cross-section, able to be arranged together in an interlocking fashion; a plurality of pole pieces; wherein at least one coil-wire wrapping of such plurality of coil-wire wrappings surrounds at least one pole piece of such plurality of pole pieces; wherein, when such plurality of coil-wire wrappings are arranged in an interlocking fashion, adjacent coil-wire wrappings exhibit at least one coil-wire overlap between each pole piece of such plurality of pole pieces. Moreover, it provides such a musical instrument pickup, wherein such a geometric cross-section is a rhombic cross section. Additionally, it provides such a musical instrument pickup, wherein: such plurality of independent coil-wire wrappings comprises a plurality of independent coil-wire wrappings wherein such geometric cross-section is a rhombic cross section, and at least two independent coil-wire wrappings wherein such geometric cross-section is a partially rhombic and partially semicircular cross-section; wherein such plurality of independent coil-wire wrappings having a rhombic cross-section are end capped by such at least two independent coil-wire wrappings having a partially rhombic and partially semicircular cross-section. Also, it provides such a musical instrument pickup, wherein each coil-wire wrapping forms a coil angle between a bottom region of a coil-wire wrapping and a corresponding perpendicular string of the stringed instrument. In addition, it provides such a musical instrument pickup, wherein such coil angle comprises a value between about 31 degrees and about 51 degrees. And, it provides such a musical instrument pickup, wherein such coil angle comprises a value of greater than about 40 degrees. Further, it provides such a musical instrument pickup, wherein such coil angle comprises a value of about 51 degrees. Even further, it provides such a musical instrument pickup, wherein at least one coil-wire wrapping of such plurality of independent coil-wire wrappings comprises at least one supportive template around which coil wire is wrapped. Moreover, it provides such a musical instrument pickup, wherein such at least one template comprises a rhombic cross-section. Additionally, it provides such a musical instrument pickup, wherein such at least one template comprises an oval cross section. Also, it provides such a musical instrument pickup, wherein at least one pole piece, of such plurality of pole pieces, comprises a rhombic cross-section. In addition, it provides such a musical instrument pickup, wherein at least one pole piece, of such plurality of pole pieces, comprises an oval cross-section. And, it provides such a musical instrument pickup, wherein such plurality of independent coil-wire wrappings, when arranged in an interlocking fashion, are aligned in a substantially straight line. Further, it provides such a musical instrument pickup system, wherein such coil wire comprises a coil-wire gauge between about 45 gauge and about 42 gauge. Even further, it provides such a musical instrument pickup, wherein at least one of such plurality of pole pieces is magnetic.

In accordance with another preferred embodiment hereof, this invention provides a musical instrument pickup, relating to noise cancellation, comprising: a plurality of independent coil-wire wrappings, each having a geometric cross-section, able to be arranged together in an interlocking fashion; a plurality of magnetic pole pieces; wherein at least one coil-wire wrapping of such plurality of coil-wire wrappings surrounds at least one magnetic pole piece of such plurality of magnetic pole pieces; wherein, when such plurality of independent coil-wire wrappings are arranged in an interlocking fashion, adjacent coil-wire wrappings exhibit at least one coil-wire overlap between each pole piece of such plurality of pole pieces; wherein at least two independent coil-wire wrappings of such plurality of coil-wire wrappings comprise a coil-wire winding direction; wherein at least two magnetic pole pieces of such plurality of pole pieces comprises a magnetic pole orientation; wherein, to achieve noise cancellation, such at least two independent coil-wire wrappings comprise opposite coil-wire winding directions and such at least two magnetic pole pieces comprises opposite magnetic pole orientations.

In accordance with another preferred embodiment hereof, this invention provides a component of a musical instrument pickup, relating to supporting coil wire, such component comprising: a supportive template around which coil wire is to be wrapped, such at least one supportive template comprising a geometric cross-section; wherein at least two of such supportive template are structured and arranged to fit together in an interlocking fashion; wherein, when at least two of such supportive template are arranged in such interlocking fashion, and when each such supportive template is wrapped with coil wire, at least one coil-wire overlap is present between adjacent supportive templates.

In accordance with another preferred embodiment hereof, this invention provides a method of constructing a musical instrument pickup, relating to achieving a user-desired signal output level and a user-desired tonal characteristic from a stringed instrument, comprising the steps of: selecting at least one geometric cross-section to embody a plurality of independent coil-wire wrappings, each independent coil-wire wrapping of such plurality able to be arranged together in an interlocking fashion; wherein the step of selecting such at least one geometric cross-section comprises the step of selecting at least one coil angle between a bottom region of each independent coil-wire wrapping and a corresponding perpendicular string of the stringed instrument; selecting at least one coil-wire gauge for each independent coil-wire wrapping; selecting a number of winding turns of such selected coil-wire gauge for each independent coil-wire wrapping; assembling, for use with the stringed instrument, a plurality of independent coil-wire wrappings having such selected geometric cross-section, such selected coil angle, such selected coil-wire gauge, and such selected number of winding turns. Even further, it provides such a method, wherein, when such plurality of independent coil-wire wrappings are interlocked, adjacent coil-wire wrappings exhibit at least one coil-wire overlap. Even further, it provides such a method, further comprising the step(s) of: selecting a magnetic-pole orientation of at least one magnetic pole piece; selecting at least one winding direction for each independent coil-wire wrapping; arranging, for noise cancellation purpose, such selected magnetic-pole orientation and such selected winding direction. Even further, it provides such a method, wherein the step of arranging such selected magnetic pole piece pole orientation comprises the step(s) of: selecting, for each string of the stringed instrument, placement, in relation to a string of the stringed instrument, of such selected magnetic-pole orientation; selecting, in relation to other coil-wire wrappings, placement of such selected winding direction. Even further, it provides such a method, wherein the step of arranging such selected magnetic pole piece pole orientation comprises the step(s) of: selecting, for each string of the stringed instrument, placement, in relation to a string of the stringed instrument, of such selected magnetic-pole orientation; selecting, in relation to other coil-wire wrappings, placement of such selected winding direction. Even further, it provides such a method, further comprising the step(s) of selecting dimensions of such selected geometric cross-section to fit the stringed instrument.

In accordance with a preferred embodiment hereof, this invention provides a musical instrument pickup, relating to a stringed instrument having at least one string, the at least one string having a longitudinal axis, comprising: a plurality of independent coil-wire wrappings, each having a geometric cross-section, able to be arranged together in an interlocking fashion; a plurality of pole pieces, each having a center and a longitudinal axis orthogonal to the longitudinal axis of each string; wherein the center of each pole piece of such plurality of pole pieces is arranged along a line having a constant angle with respect to the longitudinal axis of the at least one string; wherein at least one coil-wire wrapping of such plurality of coil-wire wrappings surrounds at least one pole piece of such plurality of pole pieces, wherein the wrapping direction of coil wire of such at least one coil-wire wrapping is substantially orthogonal to the longitudinal axis of the pole pieces; and wherein, when such plurality of coil-wire wrappings are arranged in an interlocking fashion, a first plane, passing through a mid-point between adjacent pole pieces, such first plane being parallel to the longitudinal axis of the pole pieces and perpendicular to such line having a constant angle with respect to the longitudinal axis of the at least one string, intersects each coil-wire wrapping of adjacent coil-wire wrappings; and a second plane, passing through the longitudinal axis of a pole piece, such second plane being perpendicular to such line having a constant angle with respect to the longitudinal axis of the at least one string, intersects only one coil wire wrapping. Moreover, it provides such a musical instrument pickup, wherein such geometric cross-section is a rhombic cross section. Additionally, it provides such a musical instrument pickup, wherein: such plurality of independent coil-wire wrappings comprises a plurality of independent coil-wire wrappings wherein such geometric cross-section is a rhombic cross section, and at least two independent coil-wire wrappings wherein such geometric cross-section comprises about one-half of one rhombus completed by an approximate semicircle; wherein such plurality of independent coil-wire wrappings having a rhombic cross-section are end-capped by such at least two independent coil-wire wrappings having such geometric cross-section which comprises about one-half of one rhombus completed by an approximate semicircle. Also, it provides such a musical instrument pickup wherein each coil-wire wrapping forms a coil angle, such coil angle defined as the acute angle of such rhombic cross-section. In addition, it provides such a musical instrument pickup, wherein such coil angle comprises a value between about 31 degrees and about 51 degrees. And, it provides such a musical instrument pickup, wherein such coil angle comprises a value of greater than about 40 degrees. Further, it provides such a musical instrument pickup, wherein such coil angle comprises a value of about 51 degrees. Even further, it provides such a musical instrument pickup, wherein at least one coil-wire wrapping of such plurality of independent coil-wire wrappings comprises at least one supportive template around which coil wire is wrapped. Moreover, it provides such a musical instrument pickup, wherein such at least one supportive template comprises a rhombic cross-section. Additionally, it provides such a musical instrument pickup, wherein such at least one supportive template comprises an oval cross section. Also, it provides such a musical instrument pickup, wherein at least one pole piece, of such plurality of pole pieces, comprises a rhombic cross-section. In addition, it provides such a musical instrument pickup, wherein at least one pole piece, of such plurality of pole pieces, comprises an oval cross-section. And, it provides such a musical instrument pickup, wherein such coil wire comprises a coil-wire gauge between about 45 gauge and about 42 gauge. Further, it provides such a musical instrument pickup, wherein at least one of such plurality of pole pieces is a permanent magnet. Even further, it provides such a musical instrument pickup wherein: at least two independent coil-wire wrappings of such plurality of coil-wire wrappings comprise a coil-wire winding direction; at least two magnetic pole pieces of such plurality of pole pieces comprises a magnetic pole orientation; to achieve noise cancellation, such at least two independent coil-wire wrappings comprise opposite effective coil-wire winding directions and such at least two magnetic pole pieces comprise opposite magnetic pole orientations. Moreover, it provides such a musical instrument pickup, wherein such geometric cross-section is a polygonal cross section. Additionally, it provides such a musical instrument pickup, wherein each of such plurality of independent coil-wire wrappings is self-supporting.

In accordance with another preferred embodiment hereof, this invention provides a component of a musical instrument pickup, relating to supporting coil wire, such component comprising: a supportive template around which coil wire is to be wrapped, such at least one supportive template comprising a geometric cross-section and a longitudinal axis; wherein at least two of such supportive template are structured and arranged to fit together in an interlocking fashion; wherein, when at least two of such supportive template are arranged in such interlocking fashion, and when each such supportive template is wrapped with coil wire, at least one coil-wire overlap is present between adjacent supportive templates; wherein, when assembled in an interlocking fashion, such at least one coil-wire overlap is defined by a plane parallel to the longitudinal axis of such supportive template, such plane passing through a mid-point between adjacent pole pieces, wherein such plane intersects each coil-wire winding of adjacent coil-wire wrappings.

In accordance with another preferred embodiment hereof, this invention provides a method of constructing a musical instrument pickup, relating to achieving a user-desired signal output level and a user-desired tonal characteristic from a stringed instrument having at least one string having a longitudinal axis, comprising the steps of: selecting at least one geometric cross-section to embody a plurality of independent coil-wire wrappings, each independent coil-wire wrapping of such plurality able to be arranged together in an interlocking fashion, and further, such independent coil-wire wrappings being structured and arranged to surround at least one magnetic pole piece having a center and a longitudinal axis orthogonal to the longitudinal axis of the at least one string; wherein the step of selecting such at least one geometric cross-section comprises the step of selecting at least one coil angle, the coil angle defined by the angle formed by a longitudinally extending line oriented skew with respect to the longitudinal axis of the at least one string; selecting at least one coil-wire gauge for each independent coil-wire wrapping; selecting a number of winding turns of such selected coil-wire gauge for each independent coil-wire wrapping; and assembling, for use with the stringed instrument, a plurality of independent coil-wire wrappings having such selected geometric cross-section, such selected coil angle, such selected coil-wire gauge, and such selected number of winding turns such that, when such plurality of independent coil-wire wrappings are assembled in such interlocking fashion, and when the centers of each magnetic pole piece are arranged along a line having a constant angle with respect to the longitudinal axis of the at least one string, the musical instrument pickup is defined by a first plane, passing through a mid-point between adjacent magnetic pole pieces, such first plane being parallel to the longitudinal axis of the magnetic pole pieces and perpendicular to such line having a constant angle with respect to the longitudinal axis of the at least one string, which intersects each coil-wire winding of adjacent coil-wire wrappings; and a second plane, passing through the longitudinal axis of a magnetic pole piece, such second plane being perpendicular to such line having a constant angle with respect to the longitudinal axis of the at least one string, which intersects only one coil wire wrapping. Also, it provides such a method further comprising the step(s) of: selecting a magnetic-pole orientation of the at least one magnetic pole piece; selecting at least one effective winding direction for each independent coil-wire wrapping; arranging, for noise cancellation purpose, such selected magnetic-pole orientation and such selected effective winding direction. In addition, it provides such a method wherein the step of arranging such selected magnetic pole piece pole orientation comprises the step(s) of: selecting, for each string of the stringed instrument, placement, in relation to a string of the stringed instrument, of at least one coil-wire wrapping having such selected magnetic-pole orientation; selecting, in relation to other coil-wire wrappings, placement of at least one coil-wire wrapping having such selected effective winding direction. And, it provides such a method further comprising the step(s) of selecting dimensions of such selected geometric cross-section to fit the stringed instrument.

In accordance with another preferred embodiment hereof, this invention provides a pickup for a six string electric guitar comprising: an electric guitar having six strings of varying gauges arranged from largest gauge to smallest gauge; a pickup assembly for such electric guitar comprising six independent coil-wire assemblies, each having a geometric cross-section, able to be arranged together in an interlocking fashion, six pole pieces each having a magnetic pole orientation, a center, and a longitudinal axis orthogonal to the longitudinal axis of the string, wherein the centers of such six pole pieces are arranged along a line having a constant angle with respect to the longitudinal axis of at least one of the six strings, wherein each independent coil-wire assembly surrounds one pole piece, wherein, when such six independent coil-wire assemblies are arranged in an interlocking fashion, a first plane, passing through a mid-point between adjacent pole pieces, such first plane being parallel to the longitudinal axis of the pole pieces and perpendicular to such line having a constant angle with respect to the longitudinal axis of the at least one string, intersects each coil-wire winding of adjacent coil-wire wrappings; and a second plane, passing through the longitudinal axis of a pole piece, such second plane being perpendicular to such line having a constant angle with respect to the longitudinal axis of the at least one string, intersects only one coil wire wrapping; wherein two of such coil-wire assemblies comprise coil wire wound in a first effective winding direction, and a first magnetic pole orientation, and wherein four of such coil wire assemblies comprise coil wire wound in a second effective winding direction being opposite of such first effective winding direction, and a second magnetic pole orientation; wherein two of such coil-wire assemblies of the first wiring direction are positioned beneath the two strings of the largest gauge.

BRIEF DESCRIPTION OF THE DRAWINGS

FIG. 17A shows an exploded diagram illustrating the assembly of a pickup according to the preferred embodiment of FIG. 13 with slug or screw pole pieces.

FIG. 17B shows a top perspective diagram illustrating the pickup of FIG. 17A assembled.

FIG. 17C shows a bottom perspective diagram illustrating the pickup of FIG. 17A assembled.

FIG. 20A shows an exploded diagram illustrating the assembly of a pickup according to the preferred embodiment of FIG. 19 with slug or screw pole pieces.

FIG. 20B shows a top perspective diagram illustrating the pickup of FIG. 20A assembled.

FIG. 20C shows a bottom perspective diagram illustrating the pickup of FIG. 20A assembled.

DETAILED DESCRIPTION OF THE BEST MODES AND PREFERRED EMBODIMENTS OF THE INVENTION

Figure 1:
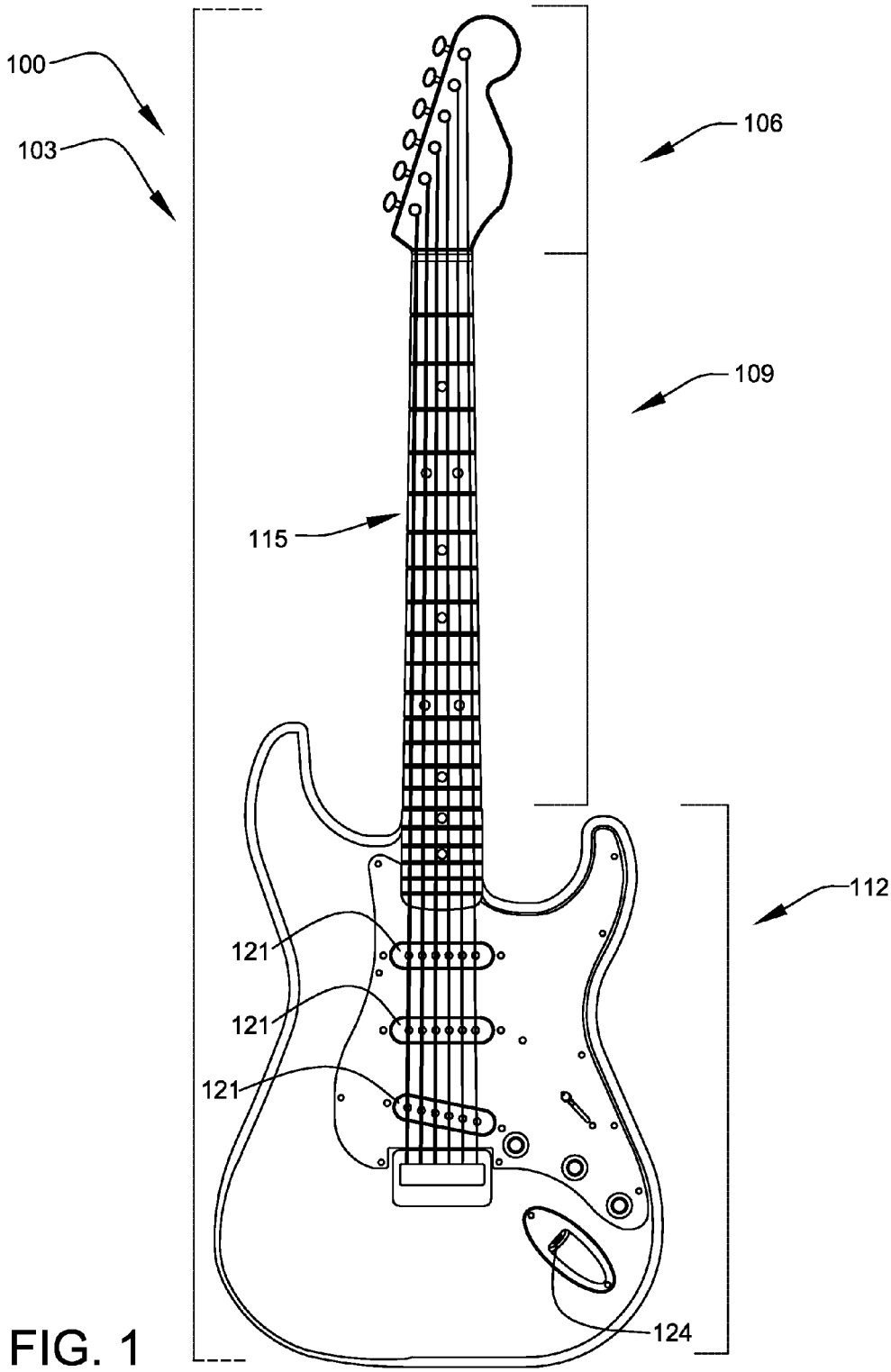
FIG. 1 shows a plan view of a musical instrument, an electric solid body guitar.

FIG. 1 shows a plan view of stringed instrument 100, an electric solid body guitar. As shown in FIG. 1, musical instrument 100, preferably guitar 103, which is illustrative of a typical solid-body electric guitar, comprises headstock 106, neck 109, and body 112. Upon reading the teachings of this specification, those of ordinary skill in the art will now understand that, under appropriate circumstances, considering such issues as trends in musician preferences, etc., other stringed instruments, such as, for example, a hollow body electric guitar, a semi-hollow body electric guitar, an electric guitar with more than six strings, e.g., a seven-string electric guitar, a twelve-string electric guitar, etc., an electric guitar with less than six strings, a electric double-neck guitar, a carved-top electric guitar, an arch-top electric guitar, an acoustic-electric guitar, an electric mandolin, an electric violin, an electric banjo, an electric stringed instrument with more than six strings, an electric stringed instrument with less than six strings, etc., may suffice.

Guitar 103 comprises strings 115 which typically comprise steel. Guitar 103, shown in FIG. 1, is commonly referred to as a six-string guitar. Strings 115 of guitar 103 are under tension from headstock 106 to a position on body 112, namely, tailpiece assembly 122, as shown. A six-string guitar, as shown in FIG. 1, comprises six strings ranging in diameter to produce different tones. Each string of strings 115 is tuned to a particular guitarist-desired pitch.

Body 112 of guitar 103 comprises electronic components 118 that assist in converting mechanical vibration of strings 115 into electrical signals. Those electrical signals are typically subsequently amplified and sounded through a loud speaker. A guitarist "frets" (i.e., changes the effective string length by pushing the string against the neck) strings 115 and vibrates strings 115 with either the fingers of the guitarist or with a plectrum, also referred to as a "flatpick" or "pick", to perform music with guitar 103.

Electronic components 118 of guitar 103 comprise "pickups" 121, as shown. Pickups are magnetic transducers that induce a current in wound coil wire positioned adjacent to a magnet. Guitar 103, shown in FIG. 1, comprises three of pickup 121. A typical guitar comprises at least one pickup 121. Electronic components 118 of guitar 103 are electrically connected to each of pickup 121 in such a way that a guitar player may select which pickup or combination of pickups will be used. This pickup selection is performed to shape the tone of the guitarists sound and provides an expressive musical component. In operation, the mechanical vibration of strings 115, such strings typically comprising steel or metal, in magnetic-field communication with a pickup, induces a current in the wound coil wire by affecting the magnetic flux of the adjacent magnet. The induced current signal, when electrically connected to an amplifier, is subsequently amplified. The amplified electric signal may then be sounded through a loud speaker as the electrical signal is converted into a mechanical wave signal.

Figure 2:
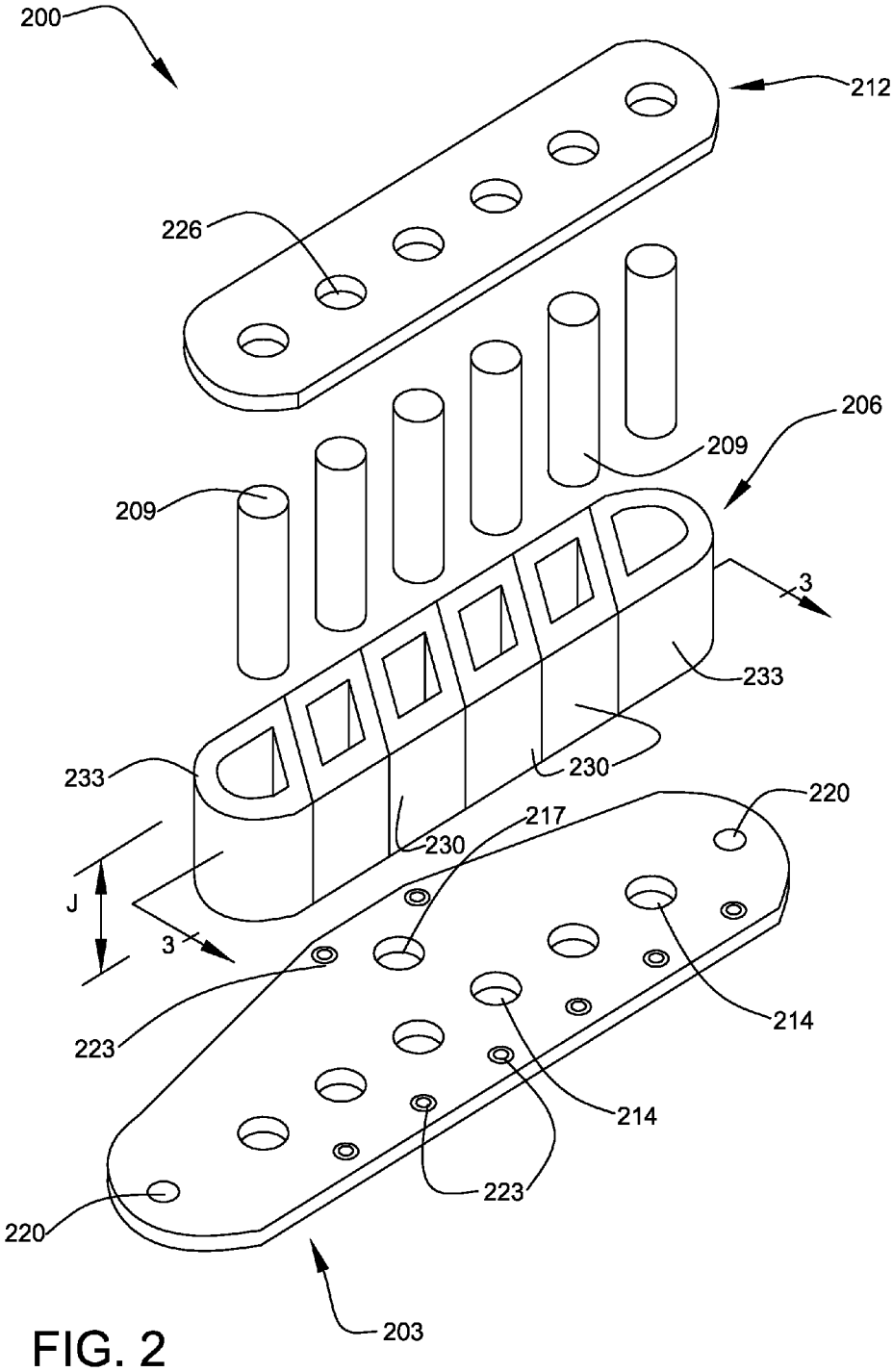
FIG. 2 shows an exploded view illustrating the components of a musical instrument pickup according to a preferred embodiment of the present invention.

FIG. 2 shows an exploded view illustrating the components of a preferred musical instrument pickup according to a preferred embodiment of the present invention. Musical instrument pickup 200 comprises the following components: bottom flatwork 203, coil assembly 206, six of pole piece 209, and top flatwork 212, as shown. Musical instrument pickup 200 is preferably designed to be compatible with the dimensions and sizing of a conventional single-coil pickup for a six-string electric guitar such that musical instrument pickup 200 will fit within a standard single-coil pickup equipped guitar, such as guitar 103 of FIG. 1, without the need for modification. Upon reading the teachings of this specification, those of ordinary skill in the art will now understand that, under appropriate circumstances, considering such issues as musician preference, future developments in musical pickup design, intended use, etc., other compatible pickup geometries and dimensions, such as a "P90" style pickup, a "full-size" "humbucking" style pickup, a Nano-mag style pickup, etc., may suffice.

Bottom flatwork 203 preferably comprises bottom pole piece apertures 214, preferably arranged in a row, as shown. Each bottom pole piece aperture 214 is designed to hold a portion of each pole piece 209 preferably with a friction fit. Alternately preferably, each pole piece 209 may be secured within pole piece aperture with an adhesive or wax. Each pole piece aperture 214 has a preferred diameter of about 0.19 inches. Bottom flatwork 203 preferably has an overall pole piece spacing of about 2.0625 inches with spacing between adjacent pole pieces of preferably about 0.4125 inches (such spacing measured from the center of each pole piece aperture center). Upon reading the teachings of this specification, those of ordinary skill in the art will now understand that, under appropriate circumstances, considering such issues as other desired flatwork dimensions, type of guitar, etc., other aperture diameters, other overall pole piece spacing dimensions, and other spacing between adjacent pole pieces, etc., may suffice.

Bottom flatwork 203 preferably comprises lead wire aperture 217 for routing lead wire from musical instrument pickup 200 essentially to output jack 124 of guitar 103 (see FIG. 1). Preferably, lead wire aperture 217 has a preferred diameter of about 0.157 inches. It is noted that lead wire from multiple musical pickup assembly 200 may be internally configured, or "wired", within a stringed instrument in a multitude of ways with other guitar components, such as switches, tone controls, and volume controls, to achieve particular musical tones.

Bottom flatwork 203 also preferably comprises mounting screw aperture 220 to receive a mounting screw to secure bottom flatwork 203 and musical instrument pickup to a guitar. Preferably, mounting screw aperture 220 has a preferred diameter of about 0.09 inches. Preferably, musical instrument pickup will be preferably height adjustable within musical instrument using art-recognized springs and mounting screws.

Bottom flatwork 203 also preferably comprises eyelets 223 to connect electrical lead connections. Bottom flatwork 203 preferably comprises two grouping of eyelets 223. A first grouping of eyelets 223 is preferably positioned near an edge of bottom flatwork 203 and between each pole piece apertures 214, as shown. First grouping of eyelets 223 preferably comprises six of eyelets 223 (preferred for a six-string electric guitar). A second grouping of eyelets 223 are preferably positioned opposite the first grouping of eyelets 223, as shown. Second grouping of eyelets 223 preferably comprises two of eyelets 223, as shown. All eyelets 223 preferably comprise brass. Upon reading the teaching of this specification, those of ordinary skill in the art will now understand that, under appropriate circumstances, considering such issues as flatwork geometry, lead wire length, etc., other arrangements for eyelets on flatwork, such as all eyelets arranged on a single side of flatwork, etc., may suffice. Coil wire from each coil-wire wrapping is preferably soldered on an underside of bottom flatwork 203. Lead wire is preferably soldered to appropriate eyelets and wired essentially to an output jack of musical instrument. Bottom flatwork 203 has a preferred width of about 0.916 inches, a preferred length of about 3.27 inches, and a preferred thickness of about 0.093 inches. Upon reading the teachings of this specification, those of ordinary skill in the art will now understand that, under appropriate circumstances, considering such issues as guitar type, pickup shape, etc., other dimensions of bottom flatwork may suffice.

Bottom flatwork 203 is preferably made of black vulcanized fiber.

Top flatwork 212 preferably comprises top flatwork apertures 226. Top flatwork 212 has the following preferred dimensions: width of about 0.61 inches, length of about 2.595 inches, thickness of about 0.062 inches, top flatwork apertures 226 diameter of about 0.185 inches, overall pole piece spacing of about 2.0625 inches with spacing between pole pieces of about 0.4125 (measured from the center of each pole piece aperture centers), and a center hole (not shown) having a diameter of about 0.107 inches. Upon reading the teachings of this specification, those of ordinary skill in the art will now understand that, under appropriate circumstances, considering such issues as guitar type, pickup shape, etc., other dimensions of top flatwork may suffice.

Top flatwork 212 is preferably made of black vulcanized fiber.

Preferred flatwork, both top flatwork components and bottom flatwork components, is available from Stewart-McDonald of Athens, Ohio. A preferred set of pickup flatwork designed for a Stratocaster® guitar is item #5955 made available from Stewart-McDonald of Athens, Ohio. Upon reading the teachings of this specification, those of ordinary skill in the art will now understand that, under appropriate circumstances, considering such issues as guitar type, pickup shape, etc., other pickup flatwork designed to fit other guitar types may suffice.

Coil assembly 206 is preferably "sandwiched" between top flatwork 212 and bottom flatwork 203, as shown. Coil assembly 206, preferably comprises four independent coil-wire wrappings each having a rhombic cross section (the "center" coil-wire wrappings) preferably capped on each end by one independent coil-wire wrapping having a rhombic/semi-circular cross section (the "end" coil wire wrappings), as shown. Alternately preferable, coil assembly 206 may be comprised entirely of interlockable coil wrappings preferably comprising a rhombic cross-section (see FIG. 7). Upon reading the teachings of this specification, those of ordinary skill in the art will now understand that, under appropriate circumstances, considering such issues as cost, materials available, amount of coil wire to be used, other coil assembly arrangements, such as having non-coil-wrapped pieces having a semi-circular cross section capping a coil wrapping having a rhombic cross section so that an assembled coil assembly will fit within a conventional guitar, etc., may suffice.

The individual coil-wire wrappings of musical instrument pickup 200 preferably interlock, or fit together in a corresponding fashion, as shown. Preferably, the individual coil-wire wrappings are secured by flatwork. Alternately preferably, the individual coil-wire wrappings may be secured to flatwork with an adhesive or a wax.

Musical instrument pickup 200 preferably comprises six pole pieces 209 having a preferred outer diameter of about 0.1875 inches. Pole pieces 209 are preferably Alnico V magnets. Pole pieces 209 are preferably self-magnetized. Alternately preferably, pole pieces 209 may be magnetically-conductive slugs influenced by an auxiliary magnet. Upon reading the teachings of this specification, those of ordinary skill in the art will now understand that, under appropriate circumstances, considering such issues as tonal preferences, output requirements, etc., other magnetic materials, such as Alnico II magnets, ceramic magnets, etc., may suffice.

Each individual coil-wire wrapping of coil assembly 206 is preferably oriented around a single magnetic pole piece 209, as shown. Upon reading the teachings of this specification, those of ordinary skill in the art will now understand that, under appropriate circumstances, considering such issues as designer preference, tonal quality desired, intended use, etc., other coil wrapping/magnetic pole piece arrangements, such as, having a coil wrapping oriented around more than one magnetic pole piece, such as around two adjacent magnetic pole pieces, around three adjacent magnetic pole pieces, around four adjacent magnetic pole pieces, around five adjacent magnetic pole pieces, etc., may suffice.

Musical instrument pickup 200 is preferably assembled by press fitting pole pieces 209 surrounded by individual coil-wire wrappings into the corresponding apertures in top flatwork 212 and bottom flatwork 203. Alternately preferably, a fastening agent such as glue, silicone caulk, or wax may be used to fix musical instrument pickup 200 together. One advantage of using a fastening agent is to prevent coils from being subject to vibration. Preferably, the individual coil windings of coil assembly 206 may be electrically coupled using eyelets 233 positioned on the side opposite of the flatwork with respect to the external lead connections, as shown in FIG. 2. Alternately preferably, all eyelets are positioned on a single side of flatwork.

Musical instrument pickup 200 is preferably wired so as to be in electronic communication with the output jack of a guitar. Coil-wire wrapping preferably comprises copper coil-wire. Individual coil wires are preferably soldered to bottom flatwork 203 after threading coil wire through an appropriate eyelet 223. Excess coil wire is preferably clipped away, and a spot of solder is placed on the eyelet, preferably on the underside of flatwork 203. One of the lead wires each from coils 1 and 6 is also preferably connected to the main lead wires connected to the second grouping of eyelets 223 to provide for external electric connection. Preferably, the individual coils-wire wrappings are wired in series. Upon reading the teachings of this specification, those of ordinary skill in the art will now understand that, under appropriate circumstances, considering such issues as user preference, intended use, desired tone, noise cancellation, etc., other wiring arrangements, such as wiring each coil wrapping in parallel, wiring groups of coil wrappings in series, wiring in parallel groups of coil wrapping wired in series with other groups of coil wrapping wired in series, etc., may suffice.

In the preferred embodiment of FIG. 2, each coil is preferably configured with the same winding direction (or electron travel) and magnetic polarity.

Figure 3:
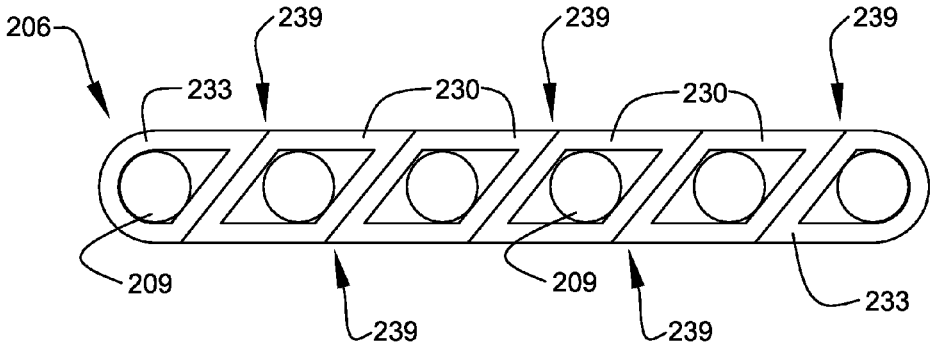
FIG. 3 shows a sectional view, through the section 3-3, of the coil wire portion of the musical instrument pickup of FIG. 2.

FIG. 3 shows a sectional view, through the section 3-3, of the coil-wire portion of the musical instrument pickup of FIG. 2. As stated above, coil-wire portion 206 of musical instrument pickup 200 comprises individual coil-wire wrappings, namely coil-wire wrapping 230 and coil-wire wrapping 233, as shown. In FIG. 3, two preferred shapes of coil-wire wrapping are shown. The coil-wire wrappings have a preferred geometric cross-section. The first preferred shape/geometric cross-section is a coil-wire wrapping having a rhombic cross section, as shown. Four coil-wire wrappings of this first preferred shape, coil-wire wrapping 230, are shown in FIG. 3. The second preferred shape/geometric cross-section is a coil-wire wrapping having a partially rhombic/partially circular cross section, as shown. Two coil-wire wrappings of this second preferred shape, coil-wire wrapping 233, are preferably used with a six-string guitar. This second preferred shape "caps" the centrally-arranged grouping of first preferred shapes.

A major preferred feature of musical instrument pickup and musical instrument pickup 200 is the overlapping coil wire, coil-wire overlap 239, in regions between pole pieces 209, as shown. The independent coil wrappings of musical instrument pickup 200 each have a preferred geometric cross-section. In FIG. 3, the preferred geometric cross section is a rhombus for the center coil-wire wrappings, coil-wire wrapping 230, and a partial rhombus/partial semicircle for the end coil-wire wrappings, coil-wire wrapping 233. Each independent coil-wire wrapping preferably surrounds pole piece 209, as shown. When the independent coil-wire wrappings are arranged in an interlocking fashion, adjacent coil-wire wrappings exhibit coil-wire overlap 239 between consecutive pole pieces. Coil-wire overlap 239 assists in providing maximum coil wire within a given limited space.

Note that the coils situated at the "caps" of coil wire portion (beneath strings 1 and 6 in a conventional six string guitar) follow the rhombic cross section on the inner half of the coil wrapping, but the outer free surface cross-section is preferably semicircular. This shape is preferred as it allows for the retrofit of musical instrument pickup 200 into a conventional single-coil pick up geometry space. It is also preferred that all six coil wrappings have a rhombic cross-section (see FIG. 9) with both a cylindrical magnetic pole piece or a magnetic pole piece having a geometric cross-section corresponding to a particular coil-wrapping cross section.

Figure 4:
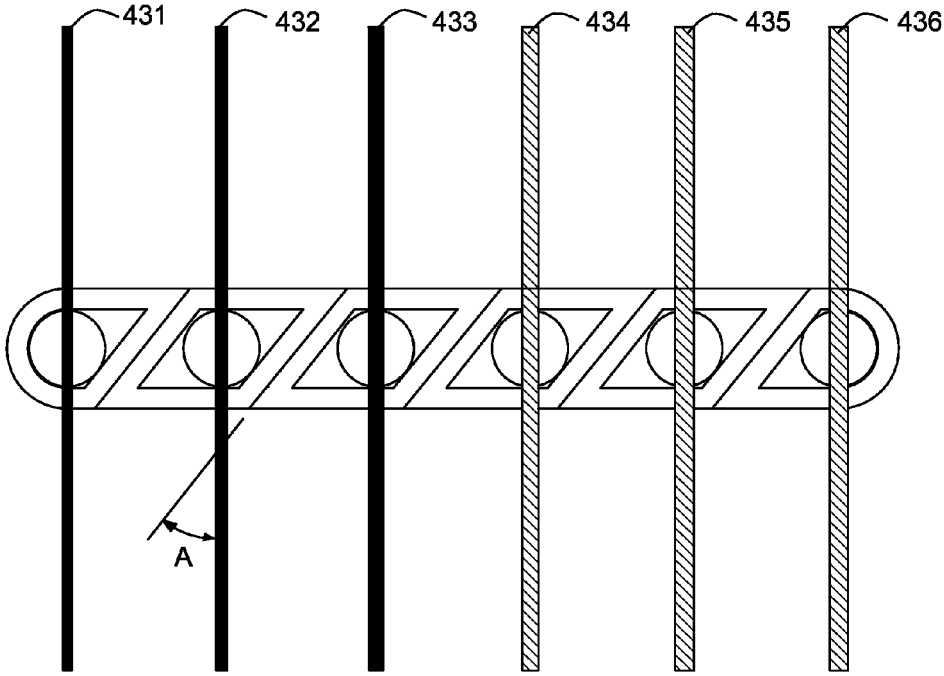
FIG. 4 shows the sectional view of FIG. 3 further illustrating musical instrument string orientation relative to coil orientation.

FIG. 4 shows the sectional view of FIG. 3 further illustrating musical instrument string orientation relative to coil orientation. Musical instrument pickup 200 is intended to be placed beneath strings of a stringed musical instrument, such as a guitar, as shown in FIG. 4. Each guitar string is positioned above pole piece 209 of musical instrument pickup 200, as shown. Shown in FIG. 4 is a typical guitar string arrangement for a six-string guitar. Six-string guitars have six strings, namely, first guitar string 431 (also typically referred to as the high "e" string), second guitar string 432 (also typically referred to as the "b" string), third guitar string 433 (also typically referred to as the "G" string), fourth guitar string 434 (also typically referred to as the "D" string), fifth guitar string 435 (also typically referred to as the "A" string), and sixth guitar string 436 (also typically referred to as the low "E" string), as shown.

Musical instrument pickup 200 forms coil angle A defined as the angle between the base side of a coil-wire wrapping and a corresponding perpendicular string. Coil angle A has a preferred value range between 59 degrees and 39 degrees, preferably less than fifty degrees, with one preferred value of 49, and with a theoretical preferred value of 39 degrees. The value of coil angle A is equal to ninety degrees less the value of the acute angle formed by the intersection of the base of the coil wrapping and the side of the coil wrapping. To more fully illustrate the coil angle value concept, for a preferred value for the acute angle formed by the intersection of the base of the coil wrapping and the side of the coil wrapping of 51 degrees, the preferred value for the coil angle equals 39 degrees.

As discussed herein, the preferred coil angles provides many advantages. The primary advantage is that the preferred coil angles allow one to lower the cross-sectional area of the coil-wire wrapping while keeping an output similar to that of a single-coil guitar pickup by virtue of having a substantially equivalent amount of coil-wire/metal around the magnetic pole piece. Further, the preferred coil angles permit applicant to use a plurality of interlocking coil wrappings having a cross sectional area such that the pickup fields of adjacent coil/magnet pole piece pairs overlap in the space between the strings forming coil-wire overlap 239. A plurality of interlocking coil-wire wrappings having a parallelogram cross-section and using a preferred coil angle provides maximum coil-wire wrapping density in a given limited space and maximizes the musical instrument pickup's output in that given limited available space. It is preferred that the bases of the individual coil wrappings be aligned in a substantially straight line. Upon reading the teachings of this specification, those of ordinary skill in the art will now understand that, under appropriate circumstances, considering such issues as user preference, intended use, etc., other alignments of the bases of the coil wrappings, such as having the entire assembly tilted with respect to the string axis, such that the bases of all of the coils form a line at a non-normal angle with respect to the axis of the string, having a staggered, or stair-stepped, configuration of coil wrappings, etc., may suffice.

Typically, as one moves farther from the center of a conventional magnetic pole piece, the magnetic field strength decreases. While applicant does not intend to be bound by theory, it is hypothesized that in the space between pole pieces 209, the strength of signal coupling into the pickup will remain relatively constant since coil wire will occupy this space in a consistent manner. When engaging in "string bending", applicant's musical instrument pickup is highly preferred as the mechanical vibrations of the guitar strings occur between adjacent pole pieces for a period of time (the duration of the string bend). Coil-wire wrappings 230 exhibit signal coupling between adjacent pole pieces along a center line perpendicular to the direction of the guitar strings. With coil winding absent between adjacent pole pieces, this signal coupling is absent.

With respect to the direction parallel to the direction of the guitar strings, signal coupling has a smaller cross-sectional area due to the lower number of coil windings needed to achieve an output similar to that of a typical single-coil guitar pickup, and thus is inherently less "noisy" since the amount of noise is directly proportional to the number of coil windings.

One aspect of musical instrument pickup 200 concerns managing the balance between the gain, or increase, in signal sensitivity in the region between adjacent coil-wire wrappings and the resulting loss in overall pickup strength through the geometric limitations in coil-wire wrapping wall thickness due to the preferred cross-section of coil windings. As the coil angle is increased from a limit of zero degrees (a square or rectangle with the coil side parallel to the string axis) the allowable thickness of the coil winding is reduced due to geometric constraints. The theoretical maximum coil wall thickness allowable between adjacent magnetic pole pieces—when the distance between each adjacent pole piece is about 0.4125 inches (measured from center to center of adjacent pole piece) and assuming a magnetic pole piece diameter of about 0.1875 inches—is about 0.113 inches for a coil winding having a square cross section. A conventional single-coil pickup has a coil wall thickness of about 0.1875.

As an illustration, at a preferred coil angle of 39 degrees, and with coil-wire wrapping 230, a coil wall thickness of about 0.052 is allowable (with coil wall thickness being measured perpendicular to the winding direction in the direction parallel to the string). As stated above, applicant's preferred embodiment achieves, within a typical guitar pickup space, equivalent output to a typical single-coil guitar with less cross-sectional coil windings.

As the allowable coil wall thickness of applicant's preferred rhombic cross section of coil windings is less when compared with conventional single-coil pickups, some allowance may be required to compensate for the resulting loss of signal strength due to the reduced coil wall thickness and the subsequent loss in allowable space for additional coil windings. Two parameters may be adjusted to compensate for the reduced coil wall thickness and subsequent loss in allowable space for additional coil windings. Those two parameters are wire gauge and coil height.

With respect to wire gauge, typical single-coil pickups utilize 42-gauge copper wire and are typically wound with 5500-8000 turns of wire. Preferably, smaller than 42-gauge copper wire is used and permits more turns of wire in the smaller allowed space. Preferably, 45-gauge copper wire is used, with 44-gauge copper wire being more preferred, and 43-gauge copper wire being most preferred. With 44-gauge copper wire, 7,500 turns are preferred. With 43-gauge copper wire, 6,000 turns are preferred. The more turns of coil wire, the more coil wire/metal is packed within a given space. With an equivalent amount of metal to a typical single coil pickup, the output will be essentially the same.

With respect to coil height, conventional single-coil pickups coils are about 0.4375 inches in height. Preferably, coil height J (see FIG. 2) of the coil-wire wrapping is greater than 0.4375 inches with a preferred height of about 0.5 inches. Combining increased coil height with lighter gauge copper wire would allow for the proposed pickup to have an extended output range as a higher number of windings may be used.

Figure 5:
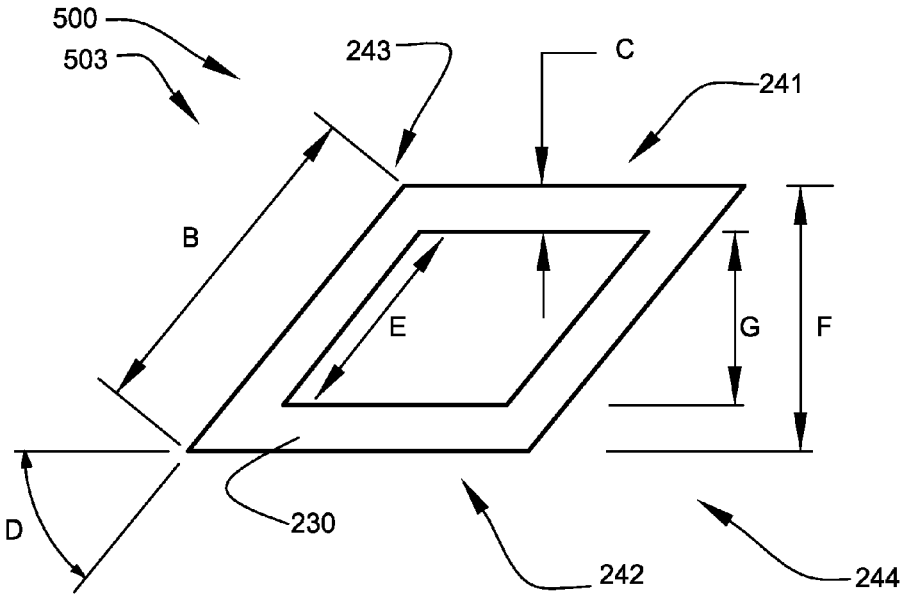
FIG. 5 shows a schematic view of a preferred "center" coil of FIG. 2.

FIG. 5 shows a schematic view of a preferred "center" coil of FIG. 2.

Coil-wire wrapping 230 having a rhombic cross section is the preferred coil wrapping configuration to be placed beneath second guitar string 432, third guitar string 433, fourth guitar string 434, and fifth guitar string 435 of a six-string guitar in the preferred embodiment of FIG. 2. Coil-wire wrapping 230 comprising rhombic cross section comprises four sides having an external width and an internal width defining coil-wire wrapping thickness C. Coil-wire wrapping thickness C is dependent on the gauge of coil wire and on the number of turns of coil wire used. Coil-wire wrapping preferably comprises top region 241, bottom region 242, left region 243, and right region 244, as shown. Coil-wire wrapping 230 preferably has geometrically shaped cross section 500, preferably rhombus cross-section 503, as shown. Preferably coil-wire wrapping comprises side length B. All sides of coil-wire wrapping 230 are congruent. In one preferred embodiment, the value for side length B of coil-wire wrapping 230 is preferably about 0.39 inches. The value for interior length E of coil-wire wrapping 230 is preferably about 0.257 inches. The distance from the top of top region 241 to the bottom of bottom region (measured at a ninety degree angle from the top side) is distance F, as shown. Distance F is preferably about 0.303 inches. Distance G, the internal distance from a lower portion of top region 241 to a top portion of bottom region 242 is preferably about 0.2 inches. Angle D has a preferred value of about 51 degrees. Adjacent sides of rhombus 503 are supplementary so that the corresponding angle of angle D has a value of 129 degrees. Upon reading the teachings of this specification, those of ordinary skill in the art will now understand that, under appropriate circumstances, considering issues such as chosen coil angle, desired coil-wall thickness, coil wire gauge, use of a coil wire template or support, other dimensions of coil wrapping, may suffice.

Figure 6:
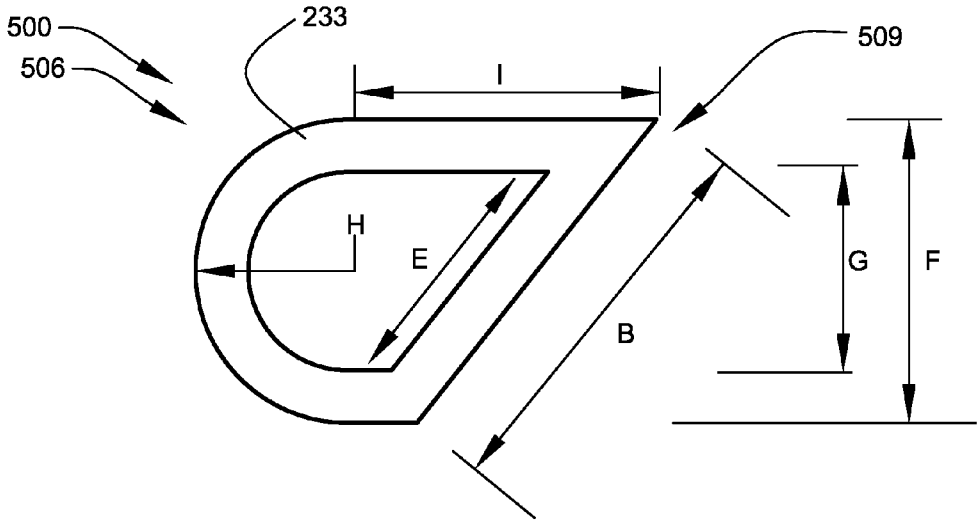
FIG. 6 shows a schematic view of a preferred "end" coil of FIG. 2.

FIG. 6 shows a schematic view of an "end" coil according to a preferred embodiment of the present invention.

Coil-wire wrapping 233 comprising rhombic/circular cross-section 506 is the preferred coil wrapping configuration to be placed beneath first guitar string 431, and sixth guitar string 436 of a six-string guitar. The dimensions of rhombic portion 509 of coil-wire wrapping 233 are similar to those described with respect to coil-wire wrapping 230 shown of FIG. 5. A preferred value radius H of semi-circular portion is about 0.1 inches.

Figure 7:
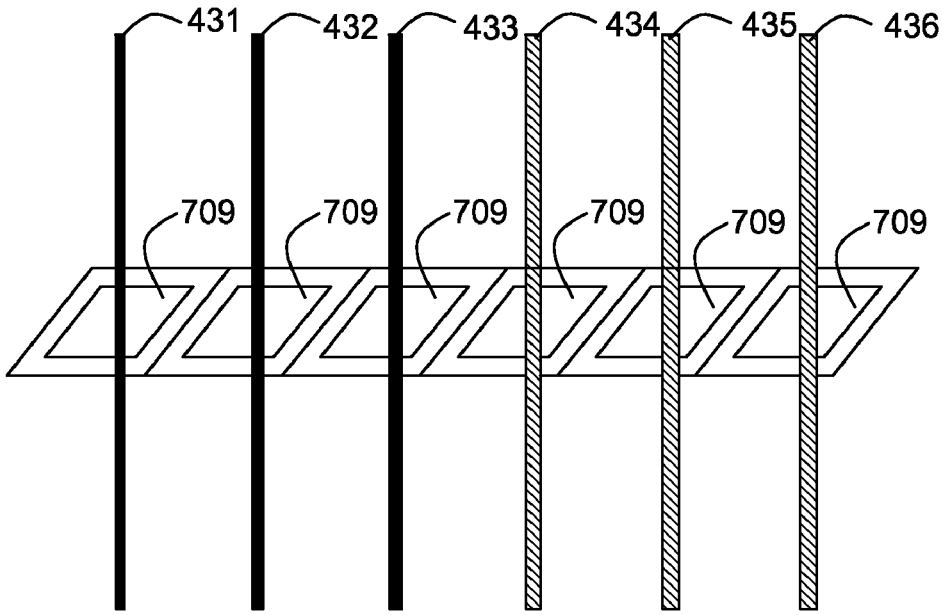
FIG. 7 shows a schematic sectional view illustrating a particular magnetic pole piece shape, namely a rhombus, and associated coil winding of a coil-wire portion of a musical instrument pickup according to another preferred embodiment of the present invention.

FIG. 7 shows a schematic view illustrating a particular pole piece shape, namely a rhombus, and associated coil winding of a coil-wire portion of a musical instrument pickup according to another preferred embodiment of the present invention. In the embodiment of FIG. 7, pole piece 709 shown would preferably comprise a rhomboidal cross-section, as shown. Alternately preferably, for placement beneath the first string and sixth string, a pole piece would preferably have a partial rhomboidal cross section on the inside facing half and a semicircular cross-section on the outside facing half (similar to the geometric shape of coil-wire wrapping shown in FIG. 6). The coil-wire wrapping associated with these magnets would employ a similar cross section. In the embodiment shown in FIG. 7, the coil wire wrapped around pole pieces 709 are preferably wound directly around the magnets. Alternately preferably, a self supporting coil with the same or substantially similar cross section may be fabricated and positioned around pole piece 709 in the final assembly.

Figure 8:
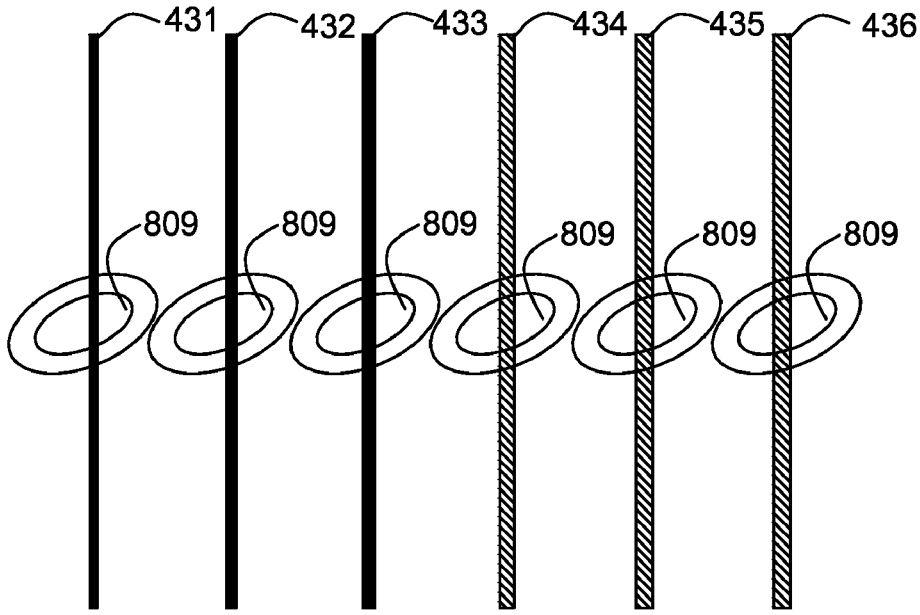
FIG. 8 shows a schematic sectional view illustrating a particular magnetic pole piece shape, namely an oval, and associated coil winding of a coil wire portion of a musical instrument pickup according to yet another preferred embodiment of the present invention.

FIG. 8 shows a schematic view illustrating a particular pole piece geometry, namely an oval, and associated coil winding of a coil wire portion of a musical instrument pickup according to yet another preferred embodiment of the present invention. In the embodiment of FIG. 8, pole pieces 809 preferably have an ovoid cross section with similarly shaped coil wire wrapped around the ovoid-shaped pole piece 809, as shown. As in FIG. 7, the coil wire may preferably be wrapped directly around the pole piece 809. Alternately preferably, a self supporting coil with the same or similar cross section may be fabricated and positioned around the ovoid pole pieces 809 in the final assembly.

Figure 9:
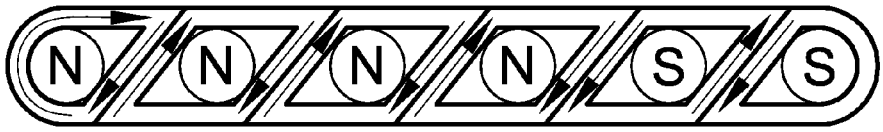
FIG. 9 shows a schematic view illustrating a particular magnetic pole orientation of the magnetic pole pieces of a musical instrument pickup used to achieve a noise-cancelling effect according to another preferred embodiment of the present invention.

FIG. 9 shows a schematic view illustrating a particular preferred magnetic pole orientation of the magnetic pole pieces of a musical instrument pickup used to achieve a noise-cancelling effect according to another preferred embodiment of the present invention.

Sixty cycle hum is a typical problem experienced by guitar players and is especially a problem in single-coil guitar pickups. For hum-cancelling performance, individual coil-wire wrappings may be configured such that opposing coils are configured in a reverse wound reverse polarity ("RWRP") configuration. Preferably, adjacent coil wrappings would have opposite polarity and winding direction compared with an adjacent coil wrapping. As an illustration, coil wrappings 1, 3 and 5 would have one magnetic polarity and winding direction while coil wrappings 2, 4 and 6 would have the opposite magnetic polarity and winding direction. In this preferred hum-canceling configuration, there is potential for partial signal cancellation in the region between the adjacent pole pieces due to the opposing magnetic fields. Preferably, magnetic shielding may be added to prevent adjacent coils from interfering with each other.

Other hum-canceling configurations are possible. As further illustration of the possibilities of hum-canceling arrangements provided with applicant's invention, coil wrappings 1, 2, and 3 may preferably comprise one magnetic polarity and winding direction while coil wrappings 4, 5, and 6 may preferably have an opposite magnetic polarity and winding direction. In this configuration, only the space between coil wrapping 3 and coil wrapping 4 would be subject to interference due to opposing magnetic polarity.

A compromise design, and a highly preferred embodiment of the hum-canceling musical instrument pickup of FIG. 9, would be to configure coil wrappings 1, 2, 3, and 4 with one magnetic polarity (N) and winding direction (clockwise) with coil wrappings 5 and 6 having an opposite magnetic polarity (S) and winding direction (counterclockwise). This preferred embodiment places the region of opposing magnetic fields between coil wrapping 4 and coil wrapping 5. This is advantageous since string 4, commonly referred to as the "D" string, is typically a wound string. Guitarists typically employ string "bending" to increase the pitch of the fretted note. String bending has the effect of shifting the center of the string vibration, relative to the coil, to the region between the adjacent coils. As strings are most commonly bent in an upward direction, in terms of string position relative to the player, the center of vibration is typically shifted towards the next highest coil wrapping/magnetic pole piece pair. As an illustration, the second string, commonly referred to as the "B" string, is more typically bent such that the center of vibration is shifted into the region between the second coil wrapping/magnetic pole piece pair and the third coil wrapping/magnetic pole piece pair. It is noted that a guitarist may bend a string downward; however, string bending is typically performed in an upward direction. It is uncommon in typical guitar playing practice to observe significant bending of the fourth string since it is thicker and also typically wound (comprise an outer winding around an inner core) making it more difficult to bend. First guitar string, second guitar string, and third guitar string (the high "e" string, the "B" string, and the "G" string) are typically "plain" and unwound, and are much more typically bent. As the fourth guitar string is not typically bent, placement of signal loss between the fourth and fifth coil wrapping/magnetic pole piece pair much less significant than if the placement of signal loss was positioned between the second coil wrapping/magnetic pole piece pair and third coil wrapping/magnetic pole piece pair. The advantage provide is that the preferred configuration (placing signal loss between the fourth and fifth coil wrapping/magnetic pole piece pair) results in a reduction of "noise" due to the noise cancelling configuration of forth coil wrapping/magnetic pole piece pair and the sixth coil wrapping/magnetic pole piece pair relative to each other. It is predicted that the noise canceling will be of the order of two-thirds.

Adjacent coils may also be configured with a partial semicircular cross-section (as in the edge coil wrappings described in FIG. 2), but with the semicircular faces adjacent one another. Preferably, fourth coil wrapping and the fifth coil wrapping would utilize this configuration. This preferred configuration concentrates pickup strength close to the magnetic pole piece and away from the region of magnetic field cancellation in the region of opposing fields between the pole pieces.

Figure 10:
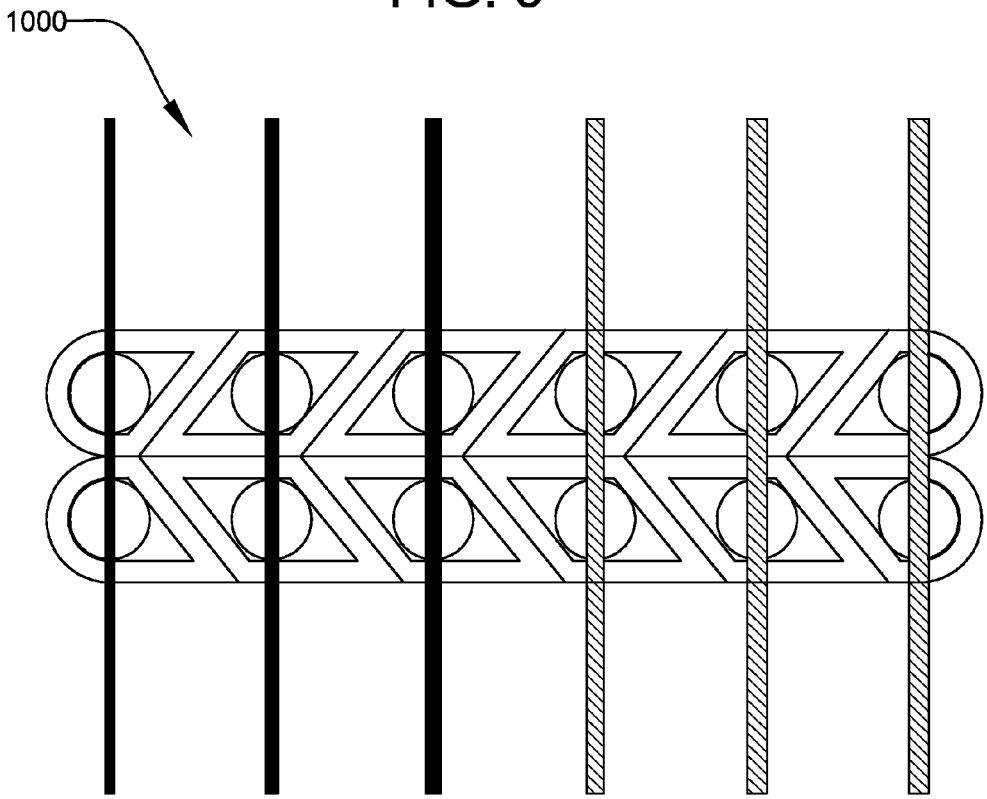
FIG. 10 shows a "humbucking" configuration of the musical instrument pickup according to a preferred embodiment of the present invention.

FIG. 10 shows a "humbucking" configuration of the musical instrument pickup according to a preferred embodiment of the present invention. Humbucking musical instrument pickup 1000 in FIG. 10 illustrates a guitar pickup having two rows of 6 coil wrappings/magnetic pole piece pairs. Humbucking musical instrument pickup 1000 illustrated in FIG. 10 is preferably configured with a RWRP configuration with respect to each other row. In this preferred embodiment, the coil-wire wrapping does not need to be wound in opposite directions in a RWRP configuration, but simply connected in reverse.

Figure 11:
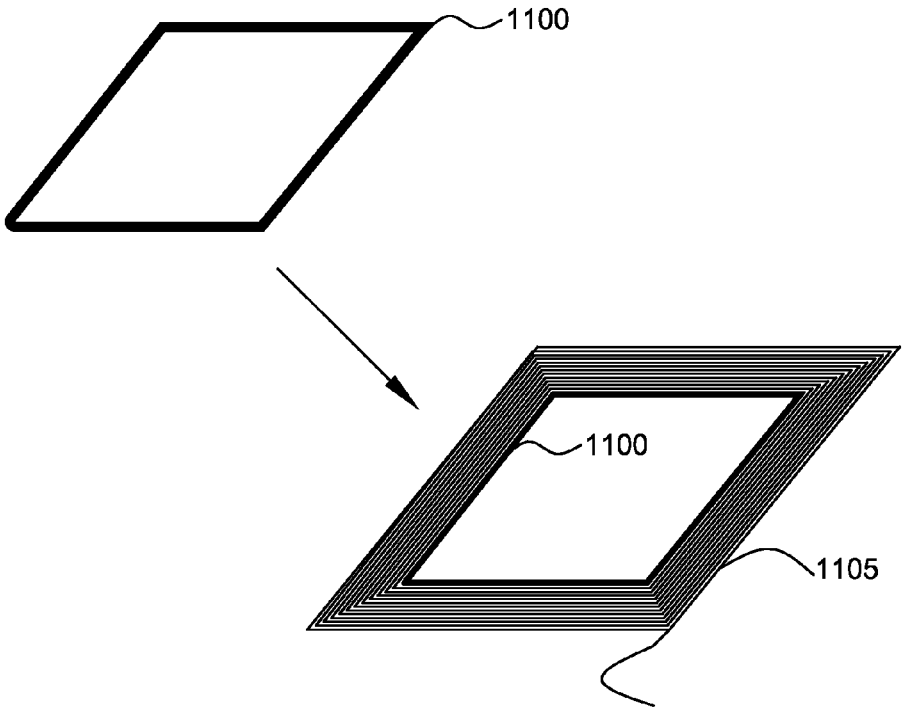
FIG. 11 shows a schematic view illustrating a supportive template around which coil wire is wrapped according to a preferred embodiment of the present invention.

FIG. 11 shows a schematic view illustrating a supportive template around which coil wire is wrapped according to a preferred embodiment of the present invention. Coil wire 1105 may preferably be wound to form the preferred geometric-shaped cross section with the assistance of supportive template 1100. As shown in FIG. 11, supportive template 1100 comprising a geometric cross-section. A preferred geometric cross-section of supportive template 1100 is a rhombus, as shown. Preferably, at least two of supportive template 1100 with wrapped coil-wire 1105 may be structured and arranged to fit together in an interlocking fashion (see FIG. 7). As in FIG. 3, when at least two of supportive template 1100 are arranged in an interlocking fashion, and when each supportive template 1100 is wrapped with coil wire 1105, the resulting configuration exhibits at least one coil-wire overlap between adjacent supportive templates 1100.

As the supportive template occupies some space, this consumes some available space for coil-wire wrapping between magnetic pole pieces. This space occupation make use of supportive template 1100 less preferred as it limits the allowable coil wall thickness of the coil wrapping. Manufacturing a self-supporting coil-wire wrapping is more preferred. Self supporting coils of this type may be fabricated by a number of suppliers, among them Dia-netics of 9510 Owensmouth Ave. #5, Chatsworth, Calif. 91311.

Figure 12:
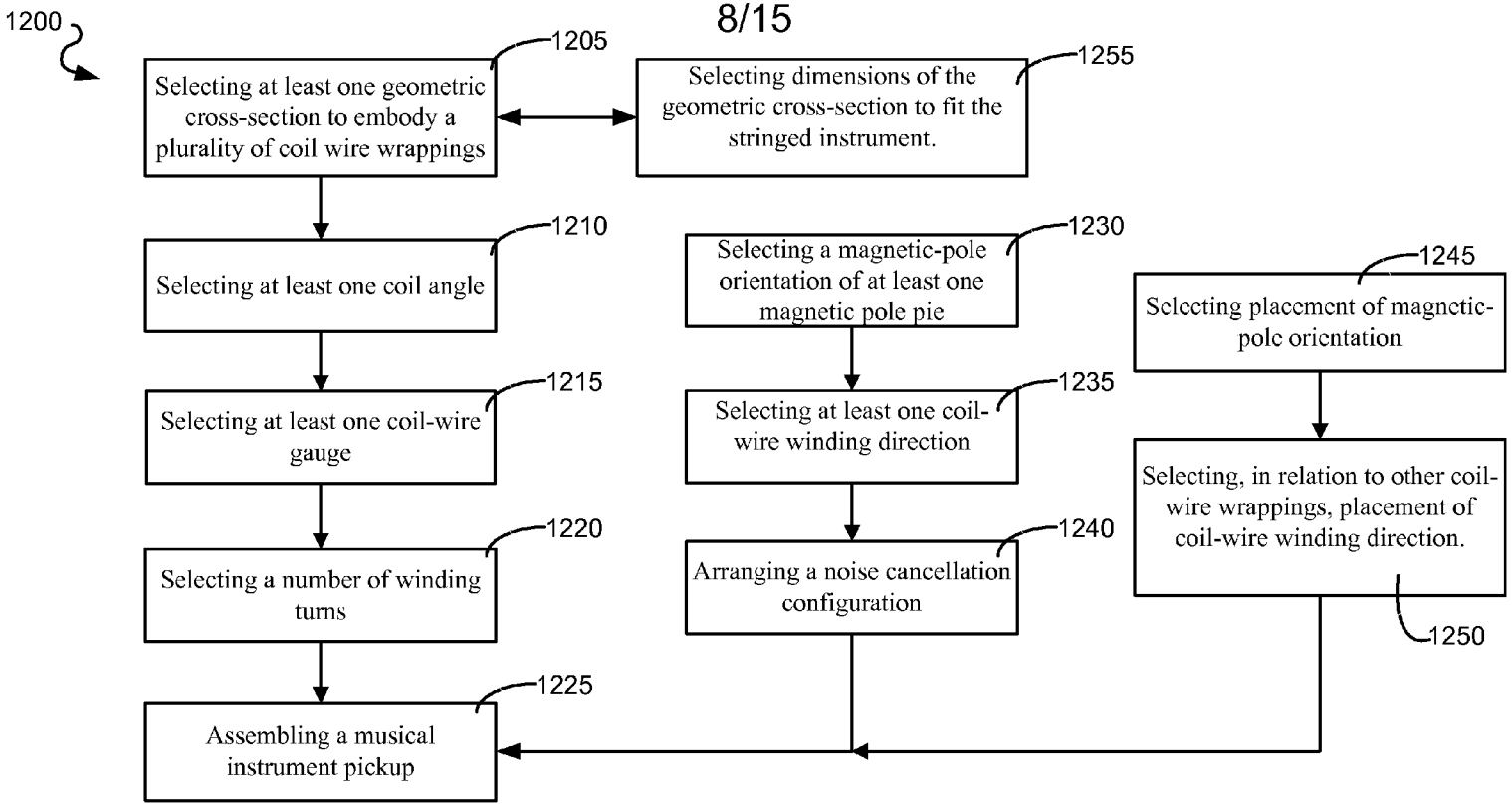
FIG. 12 shows a flowchart illustrating steps relating to a method of constructing a musical instrument pickup according to a preferred method of the present invention.

FIG. 12 shows a flowchart illustrating steps relating to a method of constructing a musical instrument pickup, method 1200, according to a preferred method of the present invention. Method 1200 comprises a number of steps that, when performed, result in constructing a musical instrument pickup with a user-desired signal output level and a user-desired tonal characteristic from a stringed instrument. Preferably, in first step 1205, one preferably selects at least one geometric cross-section to embody a plurality of independent coil-wire wrappings wherein each independent coil-wire wrapping of such plurality will be arranged together in an interlocking fashion. A preferred geometric cross section is a rhombus (see FIG. 3). An alternately preferred geometric cross section is an oval (see FIG. 8). In preferred step 1210, one preferably selects a coil angle (see discussion of coil angle above), as shown. The selected coil angle has a preferred value range from about 59 degrees to about 39 degrees. Preferably, the selected coil angle has a preferred value range less than 50 degrees. A preferred coil angle value discussed above is about 39 degrees. In preferred step 1215, one preferably selects at least one coil-wire gauge for each independent coil-wire wrapping. A preferred range of values for a selected coil-wire gauge ranges from about 45 to about 42. In preferred step 1220, one selects a number of winding turns of such selected coil-wire gauge to for each independent coil-wire wrapping, as shown. A preferred value for the selected winding turns has a range from 5500 to 8000. A factor in selecting the number of selected winding turns will be the selected coil-wire gauge. In preferred step 1225, one assembles the musical instrument pickup, for use with the stringed instrument, using the selections made in the above described steps. It should be noted that, in some instances, when the independent coil-wire wrappings having the selected geometric cross-section are interlocked, adjacent coil-wire wrappings exhibit at least one coil-wire overlap (see discussion of coil-wire overlap in relation to FIG. 3). Preferably, the assembled musical instrument pickup exhibits coil-wire overlaps. Alternately preferably, if the intent is not to exhibit a coil-wire overlap, the following steps may be performed to provide a custom designed, noise-cancellation pickup embodiment (such as is shown in FIG. 9). Still preferably, the following steps may be performed with a musical instrument pickup having coil-wire overlap.

In preferred step 1230, preferably, one selects a magnetic-pole orientation of magnetic pole piece to place in pickup flatwork. Either a "north" orientation or a "south" orientation is selected. In preferred step 1235, one preferably selects at least one winding direction for the coil-wire. Either a clockwise direction or a counterclockwise direction is selected for the winding direction. In preferred step 1240, the selected magnetic pole orientation and the selected winding direction are used to construct a "noise-cancelling" pickup configuration. A preferred configuration is shown in FIG. 9 where a "north" pole orientation is selected for string 1 to string 4 in a six string guitar, a "south" pole orientation is selected for string 5 and string 6 (preferred step 1245), a clockwise winding direction is selected for string 1 to string 4, and a counterclockwise direction is selected for string 5 and string 6 (preferred step 1250). It is noted that, using the above method, a plurality of noise-cancelling configurations are possible. Essentially, one selects placement of a selected magnetic pole orientation beneath a selected string in preferred step 1245, and one selects placement of a selected coil-wire wrapping winding direction in relation to other coil-wire wrappings in preferred step 1250, as shown.

In preferred step 1255, one selects dimensions of such selected geometric cross-section (selected in step 1205) to fit the stringed instrument. As an illustration, dimensions of geometric cross-section are chosen to retrofit an existing guitar and its space limitations with respect to guitar electronics and pickups.

Figure 13:
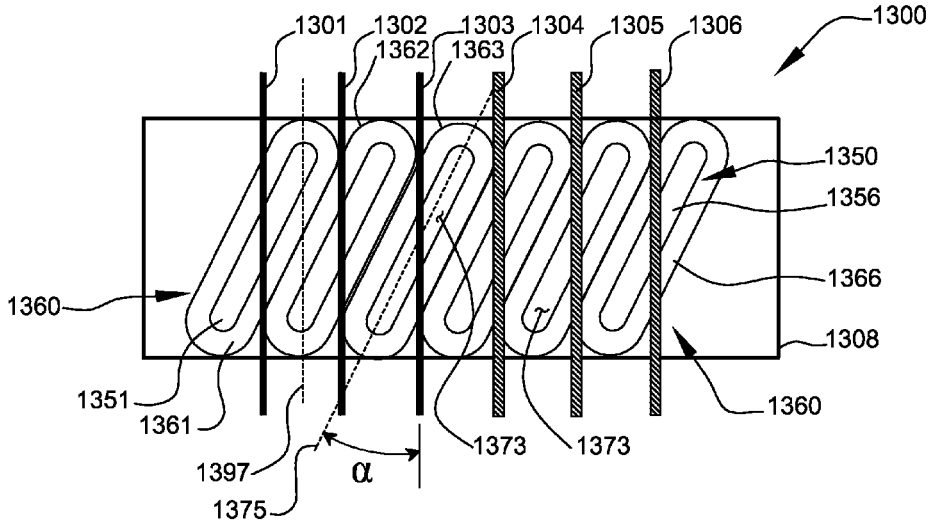
FIG. 13 shows a schematic top view of a pickup according to a preferred embodiment of the present invention with rectangular or "stadium" cross section pole pieces centered about each string.
Figure 19:
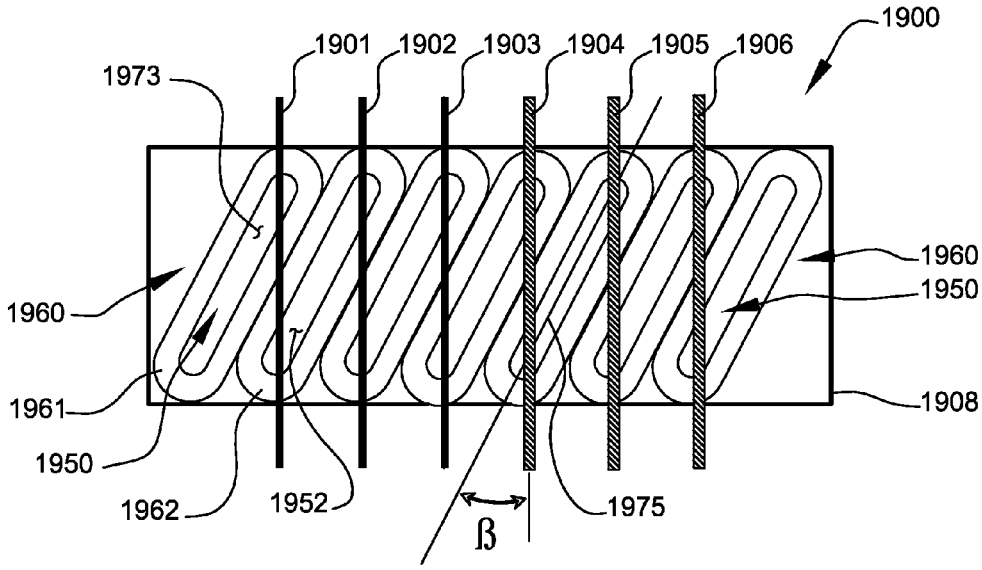
FIG. 19 shows a schematic top view of a pickup according to another preferred embodiment of the present invention with rectangular or "stadium" cross section pole pieces, with the semicircular end-caps of the stadium each centered about adjacent strings.

A discussion of preferred embodiments of another pickup follows. With reference to FIG. 13 and FIG. 19, a preferred pickup design preferably comprises a plurality of coils (also sometimes referred to herein as coil-wire wrappings) preferably having a substantially rectangular cross section. The preferred cross section may be more accurately represented as a rectangle with rounded ends or a "stadium."

FIG. 13 shows a schematic top view of pickup 1300 according to a preferred embodiment of the present invention with rectangular or "stadium" cross section coils 1360 and pole pieces 1350 centered about each string (when the string is at a resting position) of the instrument. It is noted that the strings essentially preferably lie in a "string plane" parallel to and above pickup 1300, as shown. Preferably, pickup 1300, and its components, lies essentially in a plane parallel to the aforementioned string plane.

Six strings are shown in FIG. 13, namely, string 1301, string 1302, string 1303, string 1304, string 1305, and string 1306, representing the six strings of a six-string electric guitar. For discussion purposes, string 1306 represents the string having the largest diameter relative to the other strings (typically the sixth string or the low "E" string of a six string guitar) and string 1301 represents the string having the smallest diameter relative to the other strings (typically the first string or the high "e" string of a six string guitar).

An outline of flatwork 1308 is also shown in FIG. 13. Pickup 1300 is preferably installed/connected to a musical instrument, such as a six-string electric guitar, parallel and beneath the aforementioned string plane, as shown. Preferably, any number of pickup 1300 may be placed in any number of positions between the neck and the bridge of a guitar. Upon reading the teachings of this specification, those of ordinary skill in the art will now understand that, under appropriate circumstances, the pickups of the present disclosure may be adapted or modified to be installed on other musical instruments, such as, for example, 4, 5, or 6-string bass guitars, 7-string guitars, 8-string guitars, 12-string guitars, acoustic guitars, mandolins, lap guitars, sitars, other chordophones, etc.

Preferably, coils 1360 are associated with each pole piece 1350, as shown. Each coil 1360 (or coil-wire wrapping) preferably has a cross section approximating a rectangle with rounded ends or a stadium, where the inner coil-wire wrapping preferably covers the surface and approximates the aspect ratio defined by the length and thickness of the pole piece 1350 and the width of the pole piece 1350 is positioned perpendicular to the plane of the stadium cross section. The term "stadium" as used herein is defined as a geometric figure consisting of a rectangle with top and bottom lengths a whose ends are capped off with semicircles of radius r. The area of a stadium is therefore given by the formula $A=\pi r^2+2ra$. As shown in FIG. 13 (and FIG. 19) the coils 1360 are preferably symmetrical about the longitudinal axis of the cross-section of the coils. Preferably, each coil 1360 surrounds interior 1373, as shown. Interior 1373 is that portion of the coil wire wrapping/coil 1360 that the coil wire surrounds, as shown. In some embodiments of the present invention, interior 1373 is preferably occupied by a pole piece which substantially fills the interior and approximates the cross section of a stadium and in others preferably occupied by a pole piece comprising a magnetically susceptible screw or slug. Still other preferred embodiments will consist of interior 1373 occupied by a combination of a pole piece and a matrix of magnetic or magnetically susceptible material. Preferably, the matrix may consist of a magnetically susceptible powder, such as iron powder. Preferably, in this embodiment, iron powder CAS No. 7439-89-6 with a nominal particle size of 100 mesh may suffice. Alternately preferably, magnetic powder such as AlNiCo V or AlNiCo II powder may also be used. Preferably, the magnetic or magnetically susceptible powder may also be entrained in a matrix of other material such as glue, epoxy, caulk, or other suitable carrier. The use of a magnetic matrix may, under appropriate circumstances, be applied to the embodiments disclosed in FIGS. 1-12.

When viewing a cross section of one of coil 1360 from the view shown in FIG. 13, the longitudinal axis 1375 of coils 1360 is apparent.

For discussion purposes, coils 1360 preferably lie in a coil-wire wrapping plane that is parallel to the aforementioned string plane. Preferably, coils 1360 of pickup 1300 are positioned to form a constant acute angle, illustrated in FIG. 13 as the angle $\alpha$, with respect to the longitudinal axis of a string. Stated another way, when coils 1360 are connected to the musical instrument parallel to and below the aforementioned string plane, a string projection plane of a string in the string plane that is perpendicular to the string plane and the coil-wire wrapping plane will intersect longitudinal axis 1375 forming angle a in the coil wire-wrapping plane. Preferably, angle $\alpha$ is acute, preferably between about 10 and 55 degrees. One highly preferred measure of angle $\alpha$ is about 30 degrees, with 31.1 degrees being a highly preferred measure.

Further, applicant notes the following preferred geometric arrangement to provide continuous string vibration sensing in regions between adjacent coils 1360. As shown in FIG. 13, line 1397 is preferably drawn to intersect two adjacent coils 1360 and also pass through interior 1373 of coil 1361 and interior 1373 of coil 1362, as shown. Line 1397 is preferably about equidistant from adjacent strings, as shown. Stated another way, line 1397 is preferably in the aforementioned string projection plane; a plane projection of line 1397, referred to as an inter-string projection plane, perpendicular to the aforementioned string plane and the coil-wire wrapping plane intersects interiors 1373 of adjacent coils (for example, coils 1361 and 1362). In this manner, when a string is bent from its resting position, continuous string vibration sensing may be achieved between adjacent coils (when pickup 1300 is operational as described herein).

Additionally preferably, a string projection plane of a "middle" string, for example string 1302 exhibits a preferred geometric relationship between the external perimeters of particular coils 1360. In adjusting the dimensions coil 1360, pole piece 1350, and angle a a preferred geometric arrangement wherein, for example, a string projection plane of string 1302 is about tangentially adjacent the external perimeter of coil 1361 (at an upper portion) and is also about tangentially adjacent the external perimeter of coil 1363 (at a lower portion). In this preferred geometric arrangement, line 1397 passes through the geometric center of an upper end semicircle of the "stadium" of interior 1373 of a given coil 1360 and the geometric center of the lower end semi-circle of the "stadium" of interior 1373 of an adjacent coil 1360, as shown.

As stated above, pickup 1300 preferably comprises a plurality of pole pieces 1350 preferably composed of plates, preferably rectangular, characterized by a length, width, and thickness. Preferably, six pole pieces 1350 are preferred in the embodiment of FIG. 13, as shown. Pole pieces 1350 are preferably arranged in a row, as shown. Pole piece 1356 (which may be referred to as the sixth pole piece) and pole piece 1351 (which may be referred to as the first pole piece) are preferably positioned at the outer positions of the row of pole pieces 1350, as shown. Pole pieces 1350 are preferably held in place with appropriate flatwork as discussed herein.

The pole pieces are preferably constructed of a permanently magnetic material, such as AlNiCo II or AlNiCo V. Upon reading the teachings of this specification, those of ordinary skill in the art will now understand that, under appropriate circumstances, considering timbre issues, instrument design, etc., other magnetic materials, such as Alnico III, Alnico IV, other Alnico types, ceramic, samarium cobalt, neodymium, etc., may suffice.

Alternately preferably, the pole pieces may be constructed of a magnetically susceptible material, such as iron or steel.

In this way each pole piece 1350 is positioned within the hollow center (interior 1373) of the stadium of coil 1360. Coil 1360 may be preferably directly wound on pole piece 1350, or coil 1360 may preferably be of the self supporting type, designed such that the pole piece 1350 will slip inside of coil 1360. Preferably, pole piece 1350 substantially fills interior 1373, as shown.

For reference purposes, coil 1366 is associated with pole piece 1356, coil 1361 is associated with pole piece 1351, etc.

In the preferred embodiment illustrated in FIG. 13, a given coil is positioned such that the geometric center of a plane, defined by the longitudinal axis and width of the interior of the coil, is located beneath a given string, such that a line passing through the geometric center and perpendicular to both the first plane and the longitudinal axis of the string will intersect the string when the string is in its rest position. It should be understood that this geometric arrangement is idealized in order to describe the relative geometry, and represents a perfectly constructed guitar and pickup arrangement. In practice slight deviations from these idealized geometric arrangements may occur. This embodiment is illustrated, for example, in FIGS. 13, 14A, and 14B.

In another form of this embodiment (pickup 1300) magnetically susceptible screws or slugs are substituted for the rectangular pole pieces 1350 (see for example FIG. 17B). When magnetically susceptible screws or slugs are utilized, magnets, preferably rectangular in shape, are preferably attached to the base of the pickup such that the axis of the width of the magnet is parallel to the longitudinal axis of the string. Preferably, the plane formed by the width and length of the magnet is parallel to the plane of the strings. This form of the embodiment is illustrated in FIGS. 17A, 17B, 17C, and 18.

With respect to construction of pickup 1300 (and of other pickups described herein), it is noted that the techniques previously disclosed may also be applied to the construction of preferred embodiments of the present invention disclosed hereinafter.

Additionally, the following preferred construction details may be applied to construction of pickups according to preferred embodiments of the present invention. Generally preferably, the pickups disclosed herein consist of the same basic parts: top flatwork, bottom flatwork, coils of predefined shape, dimensions, wire type, and number of windings, permanent magnets of predefined shape, dimensions and composition, and magnetically susceptible screws or slugs (if applicable). Preferably, the top and bottom flatwork will generally preferably contain the appropriate pattern of holes or slots (as required) to accept the pole piece for that design. The flatwork may also preferably incorporate a pattern of metallic eyelets or interconnects to enable the connection of the individual coils. Preferably, the flatwork may be constructed of various materials preferably including vulcanized rubber or preferably FR4 reinforced fiberglass (such as commonly used for printed circuit boards).

Preferably, the coil configuration may be adjusted over a wide range of variables, depending on the application, output level, and tone desired. What follows is a description of one preferred configuration to approximate the dimensions of a P90-type pickup, utilizing the design discussed above shown in FIG. 13. Those skilled in the art may apply these techniques and descriptions to construct pickups of all of the embodiments and forms disclosed herein. Upon reading the teachings of this specification, those with ordinary skill in the art will now understand that, under appropriate circumstances, considering such issues as desired timbre, type of guitar, new magnetic materials, etc., other pickups utilizing the teachings of this specification may suffice.

The six rectangular pole pieces may be fabricated from a preferred magnetic material such as AlNiCo V material. The preferred magnetic material may have a preferred length of approximately about 0.813 inches a width of about 0.750 inches and a thickness of about 0.063 inches. Upon reading the teachings of this specification, those of ordinary skill in the art will now understand that, under appropriate circumstances, other dimensions of the preferred magnetic material for the pole pieces may suffice.

The pole pieces are preferably polarized along the width axis, that being the axis perpendicular to both the coil wire wrapping plane and the string plane. Preferably, the face of the pole piece (perpendicular to the width axis) may be in the shape of a stadium such that radius of the semicircular end caps of the stadium is about 1/32 inch. The acute angle of the coil/pole piece pair with respect to the axis of the string (the angle $\alpha$ in FIG. 13) is preferably set to 31.1 degrees. A preferred range for the acute angle of the coil/pole piece pair is between about 10 and 55 degrees. The coils are preferably either wound directly on the pole pieces, or preferably constructed as self supporting coils. A self supporting coil will be described here. The coils may preferably be constructed from a range of wire gauges, #43 polybond copper wire or equivalent will be described here. A coil with a stadium cross section, as illustrated in the figures, should preferably be constructed. Preferably, the inner width of the stadium should be not less than about 0.075 inches to allow for clearance of the pole piece in the case of a rectangular magnet. Preferably, the inner width of the coil should be not less than about 0.093 inches to allow for clearance of the pole piece in the case of a #2-56 machine screw. Preferably, the overall inner length of the stadium should be about 0.833 inches. The height of the coil is preferably adjustable, but a preferred height of about 0.44 inches will be used for this description. Preferably, the coil wall thickness should be not more than about 0.109 inches to allow for assembly of the coils with the required string spacing. Within these dimensions, a coil composing about 6000 turns of #43 polybond wire may be preferably obtained. Upon reading the teachings of this specification, those with ordinary skill in the art will now understand that, under appropriate circumstances, considering such issues as desired timbre, etc., other wires for coil, and other number of windings, may suffice.

Preferably, a bottom flatwork of width about 3.125 inches, length about 1.156 inches and thickness about 0.093 inches should be slotted to accept the pole pieces at a preferred angle of about 31.1 degrees with respect to the length and a preferred spacing of about 0.3875 degrees along the width. Preferably, the slots should be centered overall with respect to both length and width. Preferably, the bottom flatwork should be drilled and fitted with brass eyelets (such as commonly used in pickup construction) to allow for interconnection of the individual coils, and also connection of lead wires. Preferably, a top flatwork with similar dimensions and a thickness of 0.063 about should also be constructed. Alternatively preferably, the flatwork may be constructed as a printed circuit board. Preferably, the pole pieces are first press fit into the bottom flatwork. Preferably, the individual coils are then slipped over the pole pieces and the lead wires for the individual coils are threaded through the appropriate eyelets.

A range of coil wiring and magnetic polarity combinations exists for a range of hum cancelling performance designs and performance characteristics. Upon reading the teachings of this specification, those of ordinary skill in the art will now understand that, under appropriate circumstances, considering issues such as desired timbre, desired level of hum cancelling, etc., a range of coil wiring and magnetic polarity combinations may suffice.

Preferably, the coils may then be attached to the bottom flatwork with any of a number of commonly available epoxies, caulks, or adhesives. Preferably, the top flatwork can then be attached and lead wires attached to allow for connection of the pickup to a guitar control assembly.

A range of magnet and coil orientations will be described in the following figures. Earlier narrow magnetic window/aperture designs were somewhat limited in their ability to cover the space between strings with the ability to couple string signal into the pickup. This is because the region of high strength magnetic field is limited to the vicinity of the rest position of the string in the narrow magnetic window/aperture designs. In these wider aperture designs described herein, the pole piece preferably spans space between the strings, resulting in more efficient coverage of this space. This also opens up more flexibility in hum cancelling design. For instance, in a narrow magnetic/window aperture design, a hum cancelling configuration where each coil/pole piece pair is reverse wound/reverse polarity with respect to the adjacent coil/pole piece pair is not feasible due to the tendency of the magnetic field to go to zero at the center line between the pole pieces. This results in significant output loss when strings are bent into this region. In a wider aperture design, this problem may be averted as the magnetic field can be designed to be continuous across the space between strings. The configurations illustrated in FIGS. 8-14 will not be discussed individually in detail, but utilizing the descriptions detailed herein, could be constructed by one skilled in the art.

The geometric arrangement of the preferred embodiment illustrated in FIG. 13 overcomes many of the limitations of the previously discussed embodiment (of FIGS. 2-9), the preferred example of which is illustrated in FIG. 8. As previously noted in the discussion of the embodiments illustrated in FIGS. 2-9, the tendency for signal loss in the region of zero magnetic field between adjacent pole pieces of opposite polarity limits the practical application of hum cancelling configurations in these embodiments. In the embodiment illustrated in FIG. 13, especially in the case where the interior space of the coil is substantially filled with a pole piece, the string will always be positioned directly over an active region of the pickup since there is no region of zero magnetic field associated with any line parallel to the longitudinal axis of the string. This allows for a continuous pickup pattern even in the region between adjacent pole pieces of opposite polarity, such that when a string is bent into this region, no significant loss of signal will occur. The geometry of the embodiment illustrated in FIG. 13 therefore allows for the practical application of a much wider range of hum cancelling configurations that would not be viable with the previously discussed embodiment.

Various preferred arrangements of the arrangement of pickup described in FIG. 13 will be discussed hereinafter.

Figure 14A:
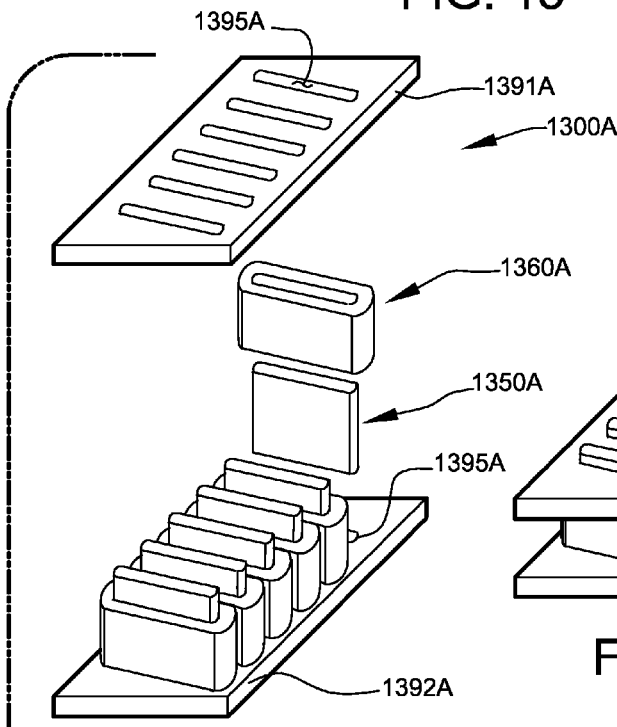
FIG. 14A shows an exploded diagram illustrating the assembly of a pickup with rectangular plate pole pieces.

FIG. 14A shows an exploded diagram illustrating the assembly of a pickup with rectangular plate pole pieces.

Figure 14B:
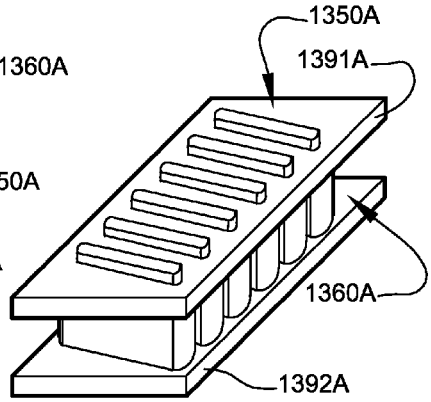
FIG. 14B shows a perspective diagram illustrating the pickup of FIG. 14A assembled.

FIG. 14A illustrates pickup 1300A. Preferably, pickup 1300A comprises pole pieces 1350A, coils 1360A, top flatwork 1391A, and bottom flatwork 1392A, as shown. As discussed above, the flatwork preferably comprises openings 1395A to expose portions of pole pieces 1350A when pickup 1300A is assembled as shown in FIG. 14B. As also discussed above, the flatwork of pickup 1300A preferably has openings and preferably metallic eyelets to permit interconnection of the coils and connection to the controls of an instrument.

FIG. 14B shows a perspective diagram illustrating the pickup of FIG. 14A assembled.

Figure 15:
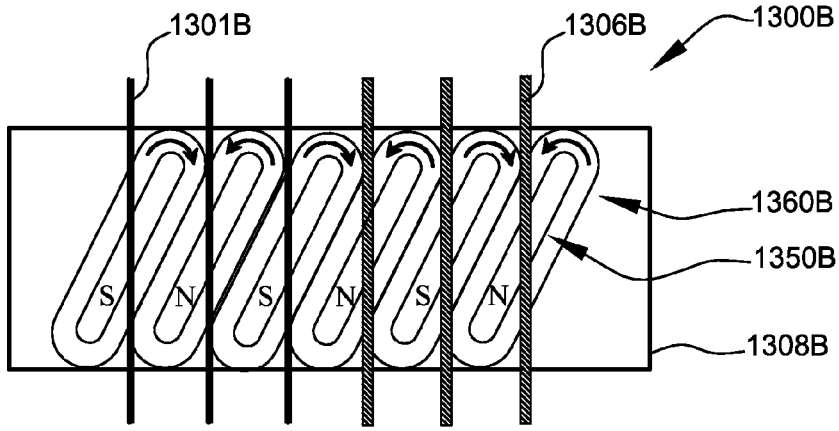
FIG. 15 shows a diagram illustrating the magnetic and coil winding orientation of a pickup of FIG. 13 with rectangular plate pole pieces designed for hum cancelling operation.

FIG. 15 shows a diagram illustrating the magnetic and coil winding orientation of a pickup of FIG. 13 with rectangular plate pole pieces designed for hum cancelling operation. In this preferred arrangement, the magnetic poles of the pole pieces 1350B facing the strings of adjacent pole pieces preferably have opposite magnetic orientation, as shown. With respect to coils 1360B associated with pole pieces 1350B, adjacent coils have opposite effective winding directions. This arrangement creates a reverse wound, reverse polarity pickup having hum-cancelling ability. The outline of flatwork 1308B is also shown in FIG. 15.

Figure 16:
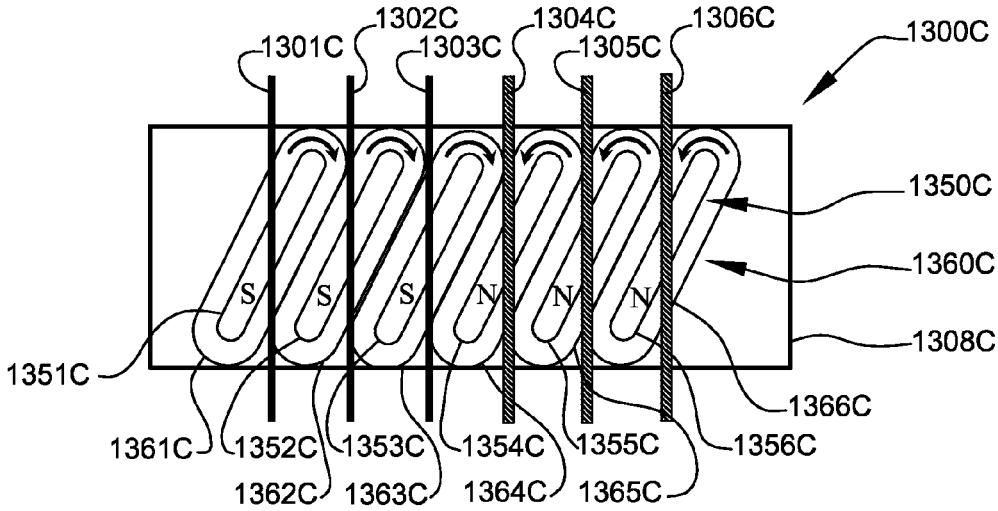
FIG. 16 shows a diagram illustrating the magnetic and coil winding orientation of a pickup of FIG. 13 with rectangular plate pole pieces designed for hum cancelling operation.

FIG. 16 shows a diagram illustrating the magnetic and coil winding orientation of a pickup of FIG. 13 with rectangular plate pole pieces designed for hum cancelling operation. Pickup 1300C of FIG. 16 preferably comprises six strings (1306C, 1305C, 1304C, 1303C, 1302C, and 1301C), six pole pieces 1350C, and six coils 1360C associated with the six pole pieces 1350C, as shown. The pole pieces (pole pieces 1351C, 1352C, and 1353C) under strings 1301C, 1302C, 1303C (typically the high "e", "B", and "G" strings) preferably have a first magnetic pole orientation facing the strings (the "South" magnetic pole is shown facing strings 1301C, 1302C, and 1303C). The coils associated with these pole pieces preferably have a first effective winding direction. The pole pieces (pole pieces 1354C, 1355C, 1356C) under strings 1304C, 1305C, and 1306C (typically the "D", "A", and low "E" strings) have a magnetic pole orientation opposite to the magnetic pole orientation of pole pieces 1351C, 1352C, 1353C (the "North" magnetic pole is shown facing strings 1304C, 1305C, and 1306C). Coils 1364C, 1365C, and 1366C preferably have an effective winding direction that is opposite the effective winding direction of coils 1361C, 1362C, and 1363C, as shown.

FIG. 17A shows an exploded diagram illustrating the assembly of a pickup according to the preferred embodiment of FIG. 13 with slug or screw pole pieces.

FIG. 17B shows a top perspective diagram illustrating the pickup of FIG. 17A assembled.

FIG. 17C shows a bottom perspective diagram illustrating the pickup of FIG. 17A assembled.

Pickup 1300D shown in FIGS. 17A, 17B, and 17C exhibits the geometric arrangement of the coils described in FIG. 13. Preferably, in pickup 1300D, coils 1360D are of the self-supporting type. Top flatwork 1391D preferably contains openings 1395D structured and arranged to receive slugs or screw pole pieces 1350D, as shown. Preferably, at least one magnet 1370D is positioned beneath bottom flatwork 1392D. As shown in FIG. 17B and FIG. 17C, pickup 1300D preferably comprises two of magnet 1370D. Magnets 1370D are preferably positioned on opposite sides of pole pieces 1350D as shown in FIG. 17C.

Figure 18:
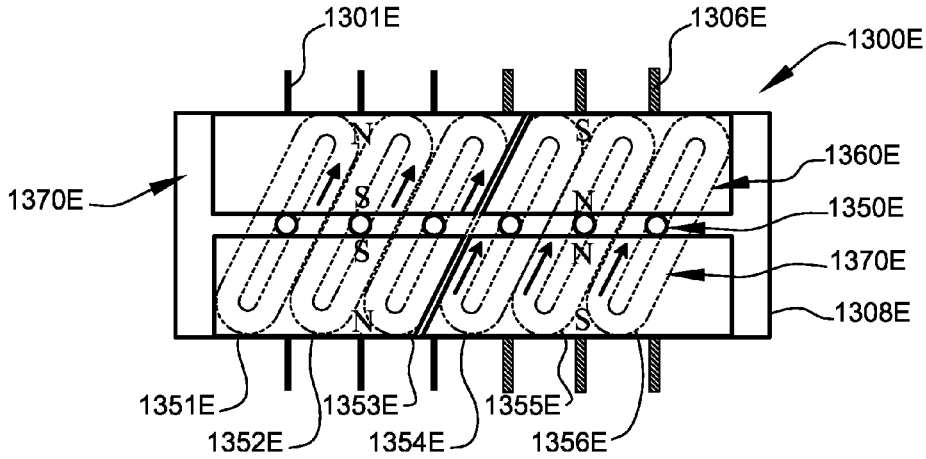
FIG. 18 shows a diagram illustrating the magnetic and coil winding orientation of a pickup of FIG. 13 with screw or slug pole pieces designed for full hum cancelling operation.

FIG. 18 shows a diagram illustrating the magnetic and coil winding orientation of a pickup of FIG. 13 with screw or slug pole pieces designed for full hum cancelling operation.

Pickup 1300E of FIG. 18 is depicted having six pole pieces 1350E of the slug or screw type. Coils 1360E are shown with each pole piece 1350E within coil 1360E. The outline of flatwork 1308E is also shown in FIG. 18. Preferably, magnetic plates 1370E are positioned about pole pieces, as shown. Preferably four magnetic plates 1370E are placed on flatwork 1308E. The magnetic plates 1370E are preferably in the shape of a right trapezoid such that the angled side of the right trapezoid conforms substantially to the angle a of FIG. 13. Preferably, on the leftmost side of pickup 1300E, the poles of the magnetic plates 1370E are positioned so that the opposing magnetic plates have similar magnetic pole orientations facing one another, as shown. On the rightmost side of pickup 1330E, the poles of the magnetic plates 1370E are positioned so that the opposing magnetic plates have similar magnetic pole orientations facing one another, as shown. Further, the magnetic pole orientation facing pole pieces 1350E on the leftmost side of pickup 1300E has an opposite magnetic pole orientation than the magnetic pole orientation facing pole pieces 1350E on the rightmost side of pickup 1300E. Preferably, coils 1351E, 1352E, and 1353E have a first effective winding direction. Preferably, coils 1354E, 1355E, and 1356E have a second effective winding direction opposite to the first effective winding direction. In this arrangement, a reverse wound reverse polarity (RWRP) situation is present leading to a full "humbucking" effect. In this arrangement, it may be desirable to utilize a magnetic or magnetically susceptible matrix to fill the remaining interior portions of the coils 1353E and 1354E. In this way, the relative strength of the magnetic field associated with these coils can be preferentially increased accounting for some of drop in localized pickup strength arising from the fact that these coils are associated with pole pieces of opposing polarity.

FIG. 19 shows a schematic top view of a pickup according to another preferred embodiment of the present invention with rectangular or "stadium cross" section pole pieces, with the semicircular end-caps of the stadium each centered about adjacent strings.

FIG. 19 illustrates pickup 1900 which is somewhat similar in design to pickup 1300 of FIG. 13. Six strings are shown in FIG. 19, namely, string 1901, string 1902, string 1903, string 1904, string 1905, and string 1906, representing the six strings of a six-string electric guitar. Upon reading the teachings of this specification, those of ordinary skill in the art will now understand that, under appropriate circumstances, the pickups of the present disclosure may be adapted or modified to be installed on other musical instruments, such as, for example, 4, 5, or 6-string bass guitars, 7-string guitars, 8-string guitars, 12-string guitars, acoustic guitars, mandolins, lap guitars, sitars, other chordophones, etc.

For discussion purposes, string 1906 represents the string having the largest diameter relative to the other strings (typically the sixth string or the low "E" string of a six string guitar) and string 1901 represents the string having the smallest diameter relative to the other strings (typically the first string or the high "e" string of a six string guitar). An outline of flatwork 1908 is also shown in FIG. 19.

FIG. 19 shows rectangular or "stadium" cross section coils 1960 arranged so that a given string (at its resting position) passes over two adjacent coils 1960, as shown, and as will be described in greater detail herein. It is noted that the strings essentially preferably lie in a "string plane" parallel to and above pickup 1900 when connected to the musical instrument, as shown. Preferably, pickup 1900, and its components, lies essentially in a plane parallel to the aforementioned string plane. Pickup 1900 is preferably installed/connected to a musical instrument, such as a six-string electric guitar, beneath the aforementioned string plane, as shown. Preferably, any number of pickup 1900 may be placed in any number of positions between the neck and the bridge of a guitar.

Preferably, coils 1960 are associated with each pole piece 1950, as shown. Each coil 1960 (or coil-wire wrapping) preferably has a cross section approximating a rectangle with rounded ends or a stadium, where the inner coil-wire wrapping preferably covers the surface and approximates the aspect ratio defined by the length and thickness of the pole piece 1950 and the width of the pole piece 1950 is positioned perpendicular to the plane of the stadium cross section.

Preferably, each coil 1960 surrounds interior 1973, as shown. Interior 1973 is that portion of the coil wire wrapping/coil 1960 that the coil wire surrounds, as shown. In some embodiments of the present invention, interior 1973 is preferably occupied by a pole piece and in others preferably occupied by a magnetically susceptible screw or slug. Still other preferred embodiments will consist of an interior occupied by a combination of a pole piece or pole pieces and a matrix of magnetic or magnetically susceptible material as discussed above. When viewing a cross section of one of coil 1960 from the view shown in FIG. 19, the longitudinal axis 1975 of coils 1960 is apparent.

For discussion purposes, coils 1960 preferably lie in a coil-wire wrapping plane that is parallel to the aforementioned string plane. Preferably, coils 1960 of pickup 1900 are positioned to form a constant acute angle, illustrated in FIG. 19 as the angle β, with respect to the longitudinal axis of a string. Stated another way, when coils 1960 are connected to the musical instrument parallel to and below the aforementioned string plane, a string projection plane of a string in the string plane that is perpendicular to the string plane and the coil-wire wrapping plane will intersect longitudinal axis 1975 forming angle β in the coil wire-wrapping plane. Preferably, angle β is acute, preferably between about 10 and 55 degrees. One highly preferred measure of angle β is about 30 degrees, with 31.1 degrees being a highly preferred measure.

Further, Applicant notes the following preferred geometric arrangement to provide continuous string vibration sensing in regions between adjacent coils 1960. As shown in FIG. 19, a given string plane projection of a given string preferably intersect two adjacent coils 1960, as shown. For example, a string plane projection of string 1901 intersects coil 1951 and coil 1952, as shown. Further, a given string projection plane of a given string intersects interiors 1973 of adjacent coils 1960, as shown. For example, a string plane projection of string 1901 intersects interior 1973 at an upper end of coil 1961 and interior 1973 at a lower end of coil 1962, as shown. In this arrangement, when a string is bent from its resting position, continuous string vibration sensing may be achieved between adjacent coils (when pickup 1900 is operational as described herein). Similarly to the geometry of the embodiment illustrated in FIG. 13, the embodiment illustrated in FIG. 19 allows for a much wider range of hum cancelling configurations compared to the embodiments discussed previously and illustrated in FIGS. 2-9.

Pickup 1900 preferably comprises a plurality of pole pieces 1950 (preferably seven for a six string guitar as shown) arranged as shown and taught herein. Each pole piece 1950 preferably comprises an associated coil 1960, as shown. Upon reading the teachings of this specification, those with ordinary skill in the art will now understand that, under appropriate circumstances, considering such issues as desired timbre, space considerations, desired angles, etc., other coil and pole piece arrangement such as coil associated with more than one pole piece, coil associated with two pole pieces, etc., may suffice.

Again, preferably using rectangular plate pole pieces 1950 (defined by a length, width, and thickness as in pickup 1300 of FIG. 13, the coil-pole piece pair (1960-1950) is preferably positioned such that the opposite ends of the stadium are positioned beneath adjacent strings. For example, one end of coil 1952/pole piece 1962 is preferably positioned beneath string 1901 and the opposing end of coil 1952/pole piece 1962 is preferably positioned be beneath string 1902, as shown.

To describe the general arrangement in another way, the case of a line (line 1980) intersecting the center of the semicircle defining the end cap of the stadium and perpendicular to the plane of the stadium, and also perpendicular to the axis of the string and intersecting the string, should suffice to define the position of the coil. As in pickup 1300 of FIG. 13, this description of the geometry represents the idealized arrangement, and allowances can be made for slight deviations from this exact geometry. Note that each string preferably intersects each of two adjacent coil-pole piece pairs in this manner. Preferably, the length of each pole piece 1950 forms an acute angle with respect to the long axis of the string, illustrated as the angle β in FIG. 19. Also note that the outermost coil-pole piece pair on each side of pickup 1900 is preferably associated only with one string. Preferably, if the number of strings for a particular stringed musical instrument, such as a guitar is "n", then the preferred number of coil-pole piece pairs in the design of pickup 1900 will be "n+1".

Preferably, pole pieces 1950 may be constructed of a permanently magnetic material, such as ANiCo II or ANiCo V. Upon reading the teachings of this specification, those of ordinary skill in the art will now understand that, under appropriate circumstances, considering timbre issues, instrument design, etc., other magnetic materials, such as AlNiCo III, AlNiCo IV, other AlNiCo types, ceramic, samarium cobalt, neodymium, etc., may suffice.

Alternately preferably, pole pieces 1950 may also be constructed of a magnetically susceptible material, such as iron or steel. As mentioned above, a coil (coil 1960) is preferably associated with each pole piece 1950, such that each coil preferably has a cross section approximating a stadium, where the inner coil wrapping is covering the surface and approximating the aspect ratio defined by the length and thickness of the pole piece and the width of the pole piece is positioned perpendicular to the plane of the stadium. In this way the pole piece is positioned within the hollow center of the stadium. Preferably, the coil may be directly wound on the pole piece, or, alternately preferably, the coil may be of the self supporting type, designed such that the pole piece will slip inside of it.

FIG. 20A shows an exploded diagram illustrating the assembly of a pickup according to the preferred embodiment of FIG. 19 with slug or screw pole pieces.

FIG. 20A illustrates assembly of Pickup 1900A which incorporates the coil/pole piece geometry taught in FIG. 19. Pickup 1900A preferably comprises seven coils 1960A arranged in the taught geometry, as shown. Coils 1960A are preferably assembled with top flatwork 1991A and bottom flatwork 1992A, as shown.

Top flatwork 1991A preferably comprise a plurality of apertures 1995A structured and arranged to receive at least one pole piece 1950A (as shown in FIG. 20B). Pickup 1900A preferably comprises 12 of aperture 1995A arranged in two rows of six apertures and appropriately angled relative to one another to allow a given pole piece to fit within an end of coil 1960A.

FIG. 20B shows a top perspective diagram illustrating the pickup of FIG. 20A assembled.

FIG. 20B shows pickup 1900A with pole pieces 1950A (preferably magnetically susceptible material or alternately preferably slugs or alternately preferably screw pole pieces) inserted into apertures 1995A, as shown. At least one rectangular plate magnet 1970A is positioned on the bottom of bottom flatwork 1992A, as shown.

FIG. 20C shows a bottom perspective diagram illustrating the pickup of FIG. 20A assembled. Rectangular plate magnet 1970A is shown preferably positioned between two rows of pole pieces 1950A. Applicant notes that in some of these designs, multiple rectangular plate magnets of varying polarity may be substituted for magnet 1970A. See, e.g., FIG. 18 and its associated description.

Using the designs taught above, a variety of hum-cancelling arrangements for the pickup arrangement taught in FIG. 19 are possible.

Figure 21:
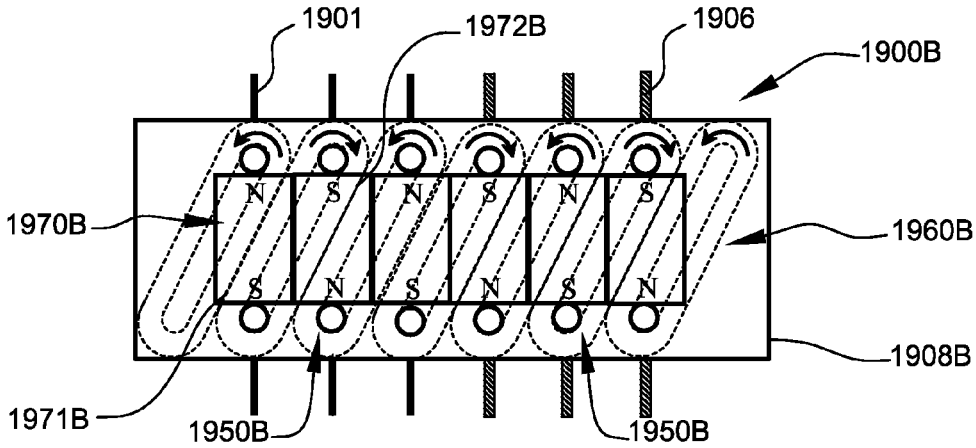
FIG. 21 shows a diagram illustrating the magnetic and coil winding orientation of a pickup of FIG. 19 with screw or cylindrical slug pole pieces designed for hum cancelling operation.

FIG. 21 shows a diagram illustrating the magnetic and coil winding orientation of a pickup of FIG. 19 with screw or cylindrical slug pole pieces designed for hum cancelling operation.

Pickup 1900B of FIG. 21 uses the arrangement shown for pickup 1900 taught in FIGS. 20A, 20B, and 20C (preferably having seven coils 1950B for a six string guitar). In the arrangement shown in FIG. 21, six magnetic plates 1970B, preferably rectangular in shape, are preferably arranged in a side-by-side manner, as shown. Magnetic plates 1970B are preferably positioned between opposing pole pieces 1950B, as shown. Preferably, the magnetic pole orientation for each magnetic plate 1970B is oriented about the length of magnetic plate 1970B, as shown. Preferably, magnetic plates 1970B are arranged side-by-side with alternating magnetic polarity. For example, the leftmost magnetic plate 1971B has shown a first pole orientation (shown as "North-South"), the adjacent magnetic plate, magnetic plate 1972B has an opposite magnetic pole orientation (shown as "South-North"), and so-on. The pickup of FIG. 21 uses preferably screw or alternately preferably cylindrical slug pole pieces. With respect to coil winding, adjacent coils have opposite effective windings, as shown. This arrangement provides a hum cancelling pickup.

Figure 22:
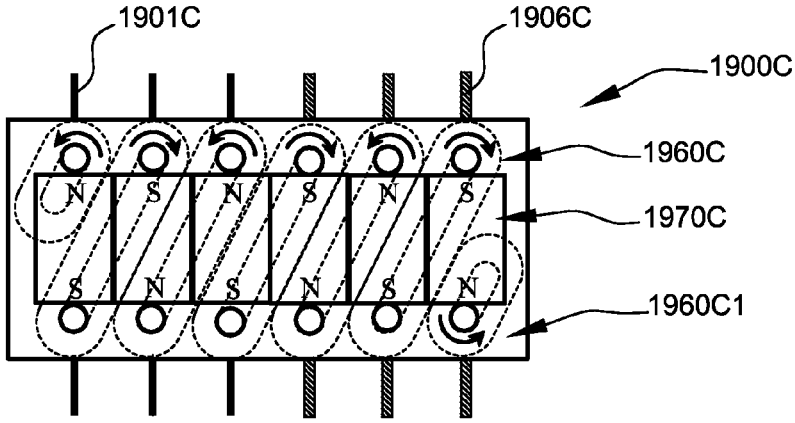
FIG. 22 shows a diagram illustrating the magnetic and coil winding orientation of a pickup of FIG. 19 with screw or cylindrical slug pole pieces and shortened outer coils designed for hum cancelling operation.

FIG. 22 shows a diagram illustrating the magnetic and coil winding orientation of a pickup of FIG. 14 with screw or cylindrical slug pole pieces and shortened outer coils designed for hum cancelling operation. Pickup 1900C of FIG. 22 is substantially similar to that of FIG. 21 except that the outer coils 1960C1 are shortened variant of coil 1960C, as shown. This arrangement is a preferred space-saving arrangement.

Figure 23:
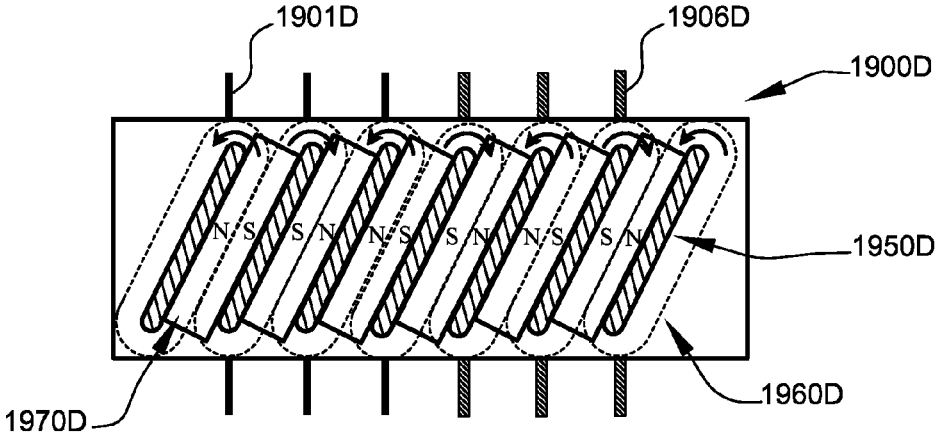
FIG. 23 shows a diagram illustrating the magnetic and coil winding orientation of a pickup of FIG. 19 with rectangular magnetically susceptible plate pole pieces and rectangular plate magnets designed for hum cancelling operation.

FIG. 23 shows a diagram illustrating the magnetic and coil winding orientation of a pickup of FIG. 19 with rectangular magnetically susceptible plate pole pieces and rectangular plate magnets designed for hum cancelling operation.

In the pickup of FIG. 23, pickup 1900D comprises a plurality of plate magnets 1970D, preferably rectangular in shape, positioned at an angle between pole pieces 1950D (pole pieces 1950D are structurally similar to the pole pieces shown, for example, in FIG. 14A, except that they are preferably not permanently magnetic, but magnetically susceptible), as shown. Preferably, the magnetic poles of plate magnets 1970D are oriented along the width of plate magnet 1970D, as shown. Plate magnets 19070D are preferably arranged so that similar magnetic poles are facing one another between pole pieces 1950D, as shown. The effective winding direction of coils 1960D are opposite in adjacent coils.

Figure 24:
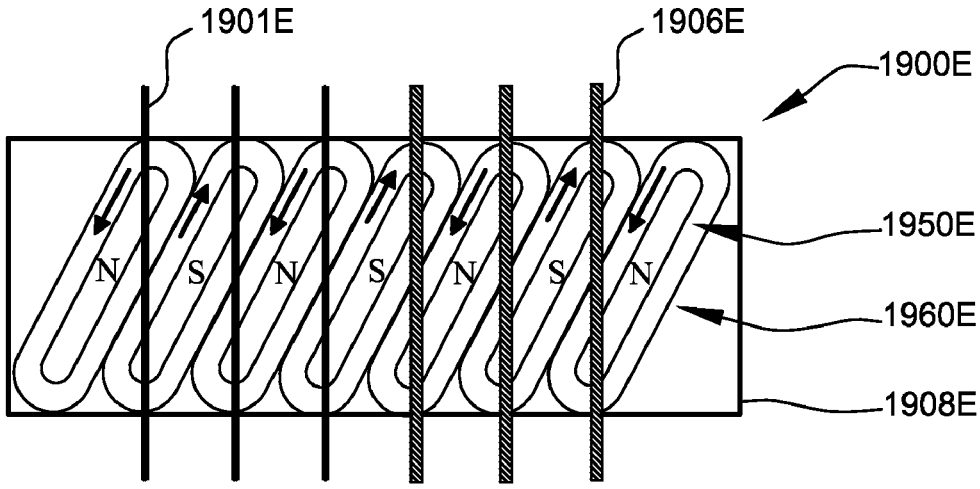
FIG. 24 shows a diagram illustrating the magnetic and coil winding orientation of a pickup of FIG. 19 with rectangular plate pole pieces designed for partial hum cancelling operation.

FIG. 24 shows a diagram illustrating the magnetic and coil winding orientation of a pickup of FIG. 19 with rectangular plate pole pieces designed for partial hum cancelling operation.

In pickup 1900E of FIG. 24, each adjacent pole piece 1950E has an opposite magnetic polarity, as shown. Further, each coil 1960E associated with adjacent coil/pole pieces has an opposite effective winding direction.

Figure 25:
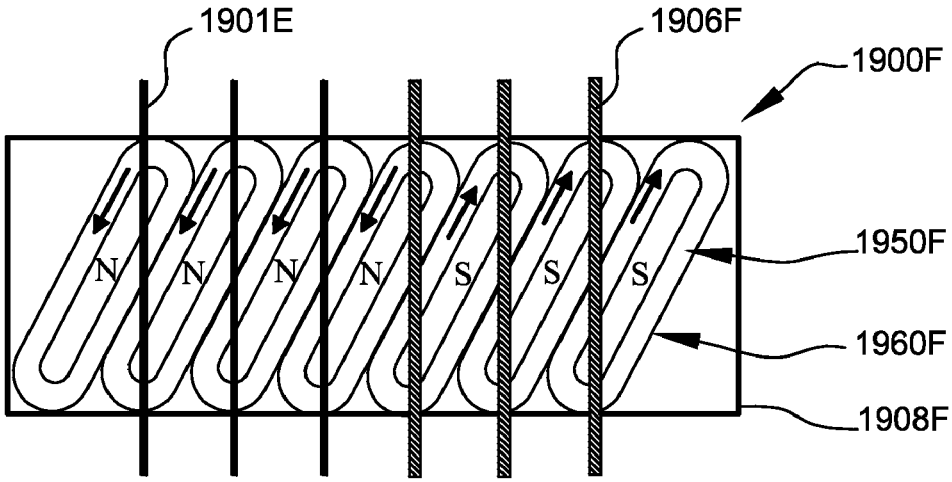
FIG. 25 shows a diagram illustrating another magnetic and coil winding orientation of a pickup of FIG. 19 with rectangular plate pole pieces designed for partial hum cancelling operation.

FIG. 25 shows a diagram illustrating another magnetic and coil winding orientation of a pickup of FIG. 19 with rectangular plate pole pieces designed for partial hum cancelling operation.

In pickup 1900F of FIG. 25, the leftmost four pole pieces 1950F have a similar magnetic pole orientation facing the strings (shown in FIG. 25 as "North"), as shown. The remaining three pole pieces 1950F, have an opposite magnetic pole orientation facing the strings (shown in FIG. 25 as "South"), as shown. Further, preferably, the four leftmost coils 1960F have a first effective winding direction. Preferably, the remaining three coils 1960F have an effective winding direction opposite that of that of the four leftmost coils 1960F, as shown. In pickup 1900F, partial hum-cancelling is achieved.

Although applicant has described the specific preferred embodiments of this invention, consisting of the respective cases where, 1) each string in its rest position is centered over the interior portion of a single coil as illustrated in FIGS. 13, and 2) each string in its rest position is over the interior portions of adjacent coils as illustrated in FIG. 19, it will be understood that any embodiment where a single plane, such plane being perpendicular to both the string plane and the coil wrapping plane and also parallel to the longitudinal axis of the strings will satisfy the general intent of these designs by providing for continuous string vibration sensing for a line parallel to the longitudinal axis of the string and contained in the string plane.

Although applicant has described applicant's preferred embodiments of this invention, it will be understood that the broadest scope of this invention includes modifications such as diverse shapes, sizes, other musical instrument pickup construction techniques, and materials. Such scope is limited only by the below claims as read in connection with the above specification. Further, many other advantages of applicant's invention will be apparent to those skilled in the art from the above descriptions and the below claims.

What is claimed is:

1. A pickup system for a stringed musical instrument comprising a plurality of strings that vibrate when the instrument is played, each string defining a longitudinal axis and at least two of the strings defining a string plane, the pickup system comprising:

a) a plurality of coil-wire wrappings for detecting vibration of the strings when the instrument is played;

b) each coil-wire wrapping comprising coil wire surrounding an interior;

c) the plurality of coil-wire wrappings being disposed below and at least substantially parallel to the string plane;

d) each of the coil-wire wrappings defining a coil-wire wrapping longitudinal axis that is at least substantially parallel to the string plane and each of the coil-wire wrappings being symmetrical about such longitudinal axis;

e) wherein a string projection plane, passing through the longitudinal axis of one of the plurality of strings and being at least generally perpendicular to the string plane, intersects at least one of the coil-wire wrapping longitudinal axes at an acute angle; and f) wherein at least one plane, that is perpendicular to the string plane and parallel to the longitudinal axis of at least one string, intersects the interiors of two adjacent coil-wire wrappings.

2. The pickup system, according to claim 1, wherein the measure of the acute angle is between about 10 and about 55 degrees.

3. The pickup system, according to claim 1, wherein each coil-wire wrapping interior has a generally rectangular cross-sectional area that is elongated along the longitudinal coil-wire wrapping axis and comprises at least one magnetic pole piece that at least substantially fills the cross-sectional area.

4. The pickup system, according to claim 3, wherein the at least one pole piece further comprises at least one screw or slug.

5. The pickup system, according to claim 1, wherein at least one string projection plane, passing through one of the plurality of strings and being at least generally perpendicular to the string plane, intersects two coil-wire wrapping interiors.

6. The pickup system, according to claim 1, wherein there are two adjacent coil-wire wrappings disposed below two respective adjacent strings;

the interiors of the adjacent coil-wire wrappings comprise pole pieces that present a magnetic field;

the magnetic pole orientations of the adjacent pole pieces and the effective winding directions of the adjacent coil-wire wrappings are structured and arranged to achieve hum canceling;

an inter-string projection plane comprises a plane that is perpendicular to the string, plane and passes through a line that is disposed between the adjacent strings and parallel to the longitudinal axis of at least one of the adjacent strings; and the pole pieces of the adjacent coil-wire wrappings are shaped, acutely angularly oriented and disposed such that every inter-string, projection plane passes through at least one pole piece and there is no region of substantially zero magnetic field parallel to the longitudinal axis of either of the adjacent strings.

7. The pickup system, according to claim 1, wherein there are two adjacent coil-wire wrapping disposed below respective adjacent strings;

the adjacent coil-wire wrappings further comprise at least one magnetic plate that presents a magnetic field;

the orientation of the magnetic field and the effective winding directions of the coil-wire wrappings are structured and arranged to achieve hum canceling therebetween;

an inter-string projection plane comprises a plane that is perpendicular to the string plane and passes through a line that is disposed between the adjacent strings and parallel to the longitudinal axis of at least one of the adjacent strings; and the interiors of the adjacent coil-wire wrappings are shaped, acutely angularly oriented and disposed such that every inter-string projection plane passes through at least one interior and there is no region of substantially zero magnetic field parallel to the longitudinal axis of either of the adjacent strings.

8. The pickup system, according to claim 1, wherein the geometric centers of the coil-wire wrappings are arranged in a single line.

9. The pickup system, according to claim 1, wherein one coil-wire wrapping is disposed below each of the strings;

an inter-string projection plane comprises a plane that is perpendicular to the string plane and passes through a line that is disposed between a pair of adjacent strings and parallel to the longitudinal axis of at least one of the adjacent strings; and the coil-wire wrapping interiors are shaped, acutely angularly oriented and disposed such that every inter-string projection plane passes through at least one coil-wire wrapping interior.

10. The pickup system, according to claim 1, wherein an inter-string projection plane positioned equidistant from adjacent strings, perpendicular to the string plane and at least generally parallel to the longitudinal axis of at least one string, intersects interiors of adjacent coil-wire wrappings.

11. The pickup system, according to claim 1, wherein the number of coil-wire wrappings equals one greater than the number of strings of the stringed musical instrument.

12. The pickup system, according to claim 1, wherein a) there are at least three strings and one of the strings is middle a string;

b) there is one coil-wire wrapping disposed below each of the three strings and each one of the coil-wire wrappings includes an external perimeter; and c) the string projection plane passing through the middle string is tangentially adjacent the external perimeters of the coil-wire wrappings below both of the other two strings.

13. A pickup system for a stringed musical instrument comprising a plurality of strings that vibrate when the instrument is played each of the strings defining a longitudinal axis and at least two of the strings defining a string plane, the pickup system comprising:

a) a plurality of coil-wire wrappings for detecting vibration of the strings when the instrument is played;

b) the plurality of coil-wire wrappings being disposed below and at least generally parallel to the string plane;

c) each of the coil-wire wrappings defining a coil-wire wrapping longitudinal axis least substantially parallel to the string plane and symmetrical about such longitudinal axis;

d) wherein an inter-string projection plane comprises a plane that is perpendicular to the string plane, passes through a line that is disposed between a pair of adjacent strings, and is at least substantially parallel to the longitudinal axis of at least one of the adjacent strings; and e) the coil-wire wrapping interiors are shaped, acutely angularly oriented and disposed such that every inter-string projection plane passes through at least one coil-wire wrapping interior.

14. The pickup system, according to claim 13, wherein there are two adjacent coil-wire wrappings disposed below two respective adjacent strings;

the interiors of the adjacent coil-wire wrappings comprise pole pieces that present a combined magnetic field;

the magnetic pole orientations of the adjacent pole pieces and the effective winding directions of the adjacent coil-wire wrappings are structured and arranged to achieve hum canceling; and the pole pieces of the adjacent coil-wire wrappings are shaped, angularly oriented and disposed such that every inter-string projection plane passes through at least one pole piece and there is no region of substantially zero magnetic field parallel to the longitudinal axis of either of the adjacent strings.

15. The pickup system, according to claim 13, wherein there are two adjacent coil-wire wrappings disposed below respective adjacent strings;

the adjacent coil-wire wrappings further comprise at least one magnetic plate that presents a magnetic field;

the orientation of the magnetic field and the effective winding directions of the adjacent coil-wire wrappings are structured and arranged to achieve hum canceling;

an inter-string projection plane comprises a plane that is perpendicular to the string plane, passes through a line that is disposed between the adjacent strings, and is parallel to the longitudinal axis of at least one of the adjacent strings; and the interiors of the adjacent coil-wire wrappings are shaped, angularly oriented and disposed such that every inter-string projection plane passes through at least one interior and there is no region of substantially zero magnetic field parallel to the longitudinal axis of either of the adjacent strings.

16. The pickup system, according to claim 13, wherein one coil-wire wrapping is disposed below each of the strings;

the inter-string projection plane comprises a plane that is perpendicular to the string plane, passes through a line that is disposed between a pair of adjacent strings, and is parallel to the longitudinal axis of at least one of the adjacent strings; and the coil-wire wrapping interiors are shaped, acutely angularly oriented and disposed such that every inter-string projection plane passes through at least one coil-wire wrapping interior, wherein an inter-string projection plane, positioned equidistant from adjacent strings, and being at least generally perpendicular to the string plane and at least generally parallel to the longitudinal axis of at least one string, intersects the interiors of two adjacent coil-wire wrappings.

17. A pickup system for a stringed musical instrument comprising a plurality of Strings that vibrate when the instrument is played, each string defining a longitudinal axis and at least two of the strings defining a string plane, the pickup system comprising:

a) a plurality of coil-wire wrappings for detecting vibration of the strings when the instrument is played, the number of coil-wire wrappings being at least equal to the number of strings;

b) each coil-wire wrapping comprising coil wire surrounding an interior;

c) the plurality of coil-wire wrappings being disposed below and at least substantially parallel to the string plane;

d) each of the coil-wire wrappings defining a coil-wire wrapping longitudinal axis that is at least substantially parallel to the string plane and each of the coil-wire wrappings being symmetrical about such longitudinal axis;

e) wherein a string projection plane, passing through the longitudinal axis of one of the plurality of strings and being at least generally perpendicular to the string plane, intersects at least one of the coil-wire wrapping longitudinal axes at an acute angle;

f) wherein the coil-wire wrappings are arranged such that there exist inter-string projection planes positioned equidistant from each pair of adjacent strings, oriented perpendicular to the string plane, extending at least generally parallel to the longitudinal axis of at least one of the adjacent strings, and intersecting the coil wire of two adjacent coil-wire wrappings; and (g) wherein at least one of the inter-string projection planes also intersects the interiors of two adjacent coil-wire wrappings.

18. The pickup system, according to claim 17, wherein the measure of the acute angle is between about 10 and about 55 degrees.

19. The pickup system, according to claim 17, wherein each coil-wire wrapping interior has a generally rectangular cross-sectional area that is elongated along the longitudinal coil-wire wrapping axis and comprises at least one magnetic pole piece that substantially fills the cross-sectional area.

20. The pickup system, according to claim 17, wherein two of the coil-wire wrappings are hum-canceling coil-wire wrappings disposed below respective adjacent strings;

the interiors of the hum-canceling coil-wire wrappings comprise acutely angularly oriented magnetic pole pieces that present respective magnetic fields; and the orientation of the magnetic fields and the effective winding directions of the hum-canceling coil-wire wrappings are structured and arranged to cancel hum induced by external electric fields and there is no region of substantially zero magnetic field aligned parallel to the longitudinal axis of either of the adjacent strings.

* * * * *